US011691244B2

(12) United States Patent
Swedek

(10) Patent No.: US 11,691,244 B2
(45) Date of Patent: Jul. 4, 2023

(54) MULTI-TOOTHED, MAGNETICALLY CONTROLLED RETAINING RING

(71) Applicant: Applied Materials, Inc., Santa Clara, CA (US)

(72) Inventor: Boguslaw A. Swedek, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 179 days.

(21) Appl. No.: 17/360,138

(22) Filed: Jun. 28, 2021

(65) Prior Publication Data

US 2022/0009053 A1 Jan. 13, 2022

Related U.S. Application Data

(60) Provisional application No. 63/049,609, filed on Jul. 8, 2020.

(51) Int. Cl.

| | |
|---|---|
| ***B24B 37/32*** | (2012.01) |
| ***B24B 49/04*** | (2006.01) |
| ***B24B 37/013*** | (2012.01) |

(52) U.S. Cl.

CPC ..... *B24B 37/32* (2013.01); *B24B 37/013* (2013.01); *B24B 49/045* (2013.01)

(58) Field of Classification Search

None

See application file for complete search history.

(56) References Cited

U.S. PATENT DOCUMENTS 5,795,215 A 8/1998 Guthrie et al.
6,059,638 A * 5/2000 Crevasse ..... B24B 37/14 451/41
6,121,142 A * 9/2000 Crevasse ..... B24B 47/00 438/692
6,143,127 A 11/2000 Perlov et al.
(Continued)

FOREIGN PATENT DOCUMENTS

JP 9141550 6/1997
JP H09141550 A * 6/1997
(Continued)

OTHER PUBLICATIONS

International Search Report dated Oct. 18, 2021 for Application No. PCT/US2021/039438.

*Primary Examiner* — Don M Anderson
*Assistant Examiner* — Jonathan R Zaworski
(74) *Attorney, Agent, or Firm* — Patterson + Sheridan, LLP

(57) ABSTRACT

A system and method for polishing a substrate, and a retaining ring assembly therefor, are described herein. A retaining ring assembly is configured to be attached to a carrier head. The retaining ring assembly includes a retaining ring including a lower surface, an inner surface, an outer surface and a plurality of grooves, where the lower surface is configured to contact a polishing pad during a polishing process, and each of the plurality of grooves are formed in the lower surface and extend from the inner surface to the outer surface. The retaining ring assembly includes a plurality of retainers, each retainer including a movable tooth at least partially disposed in a respective groove of the retaining ring and moveable relative to the lower surface.

16 Claims, 11 Drawing Sheets

(56) References Cited

U.S. PATENT DOCUMENTS 6,186,880 B1 2/2001 Gonzalez et al.
6,224,472 B1 5/2001 Lai et al.
6,251,215 B1 6/2001 Zuniga et al.
6,290,584 B1 * 9/2001 Kim ..... B24B 53/017 451/288
6,354,928 B1 * 3/2002 Crevasse ..... B24B 37/32 451/41
6,375,549 B1 * 4/2002 Glashauser ..... B24B 37/30 451/63
6,454,637 B1 * 9/2002 Gotkis ..... B24B 37/30 451/60
6,773,338 B2 * 8/2004 Yun ..... B24B 49/04 451/41
6,857,950 B2 * 2/2005 Hayashi ..... B24B 41/068 438/692
6,863,771 B2 * 3/2005 Brown ..... B24B 1/005 451/41
7,029,381 B2 4/2006 Melvin et al.
7,186,171 B2 3/2007 Oh et al.
7,276,743 B2 * 10/2007 Manens ..... B24B 37/32 257/E21.216
7,326,105 B2 * 2/2008 Chandrasekaran ..... B24B 37/32 451/285
7,520,795 B2 * 4/2009 Wang ..... B24B 37/32 451/36
7,608,173 B2 * 10/2009 Manens ..... B24B 37/32 204/297.06
7,867,060 B2 1/2011 Aritomo et al.
8,517,803 B2 * 8/2013 Sather ..... B24B 37/32 451/286
9,227,297 B2 * 1/2016 Rahmathullah ..... B24B 37/32
9,368,371 B2 6/2016 Oh et al.
9,403,255 B2 * 8/2016 Fukushima ..... B24B 49/16
9,434,044 B2 * 9/2016 Kosuge ..... B24B 37/0053
9,472,475 B2 10/2016 Xu et al.
10,702,972 B2 * 7/2020 Fukushima ..... B24B 37/32
11,400,561 B2 * 8/2022 Kobayashi ..... H01L 21/6776
2004/0152403 A1 8/2004 Marohl et al.
2005/0191947 A1 9/2005 Chen et al.
2005/0282322 A1 12/2005 Manens et al.
2009/0021024 A1 1/2009 Prabhu et al.
2010/0112914 A1 5/2010 Marohl et al.
2015/0021498 A1 1/2015 Hsu et al.
2015/0303070 A1 10/2015 Oh et al.
2016/0346897 A1 12/2016 Reedy et al.
2019/0270180 A1 9/2019 Lin
2020/0130131 A1 * 4/2020 Togawa ..... H01L 21/304
2021/0308823 A1 * 10/2021 Watanabe ..... B24B 37/013

FOREIGN PATENT DOCUMENTS

JP 2000094311 4/2000
KR 100764040 B1 10/2007
KR 10-2019-0114106 10/2019

* cited by examiner

MULTI-TOOTHED, MAGNETICALLY CONTROLLED RETAINING RING

CROSS-REFERENCE TO RELATED APPLICATIONS

This application claims the benefit of U.S. Provisional Patent Application Ser. No. 63/049,609, filed on Jul. 8, 2020, the entirety of which is herein incorporated by reference.

BACKGROUND

Field

Embodiments of the present disclosure generally relate to an apparatus and method for polishing and/or planarization of substrates. More particularly, embodiments of the disclosure relate to retaining assemblies for carrier heads utilized for chemical mechanical polishing (CMP).

Description of the Related Art

During fabrication of a semiconductor device, various layers such as oxides and copper for example, require polishing to remove steps or undulations before formation of subsequent layers. Polishing is useful in removing undesired surface topography and surface defects, such as rough surfaces, agglomerated materials, crystal lattice damage, scratches, and contaminated layers or materials. Polishing is also useful in forming features on a substrate by removing excess deposited material used to fill the features and to provide an even surface for subsequent levels of metallization and processing.

Polishing is typically performed mechanically, chemically, and/or electrically using processes such as chemical mechanical polishing (CMP) or electro-chemical mechanical polishing (ECMP).

CMP removes material from the surface of a substrate in the presence of a slurry through a combination of mechanical and chemical interaction. During CMP, the slurry is delivered on to a rotating polishing pad, and the substrate is pressed against the polishing pad by a carrier head. The carrier head may also rotate and move the substrate relative to the polishing pad. As a result of the motion between the carrier head and the polishing pad and chemicals included in the slurry, the substrate surface is planarized.

The carrier head includes a membrane having a plurality of different radial zones that contact the substrate. In some embodiments, the membrane may include three or more zones, such as from 3 zones to 11 zones, for example, 3, 5, 7 or 11 zones. Using the different radial zones, pressure applied to a chamber bounded by the backside of the membrane may be selected to control the center to edge profile of force applied by the membrane to the substrate, and consequently, to control the center to edge profile of force applied by the substrate against the polishing pad. The zones are typically labeled from outer to inner (e.g., from zone 1 on the outside to zone 11 on the inside for an 11 zone membrane). A common problem in CMP is occurrence of an edge effect (i.e., the over- or under-polishing of the outermost 5-10 mm of a substrate). In an effort to remove the edge effect, the outer zones (typically referred to as zones 1 and 2) of the membrane are spaced more closely together than the inner zones (typically referred to as zones 10 and 11) to provide more precise pressure control over a shorter radial distance at the outer edge. However, such close spacing can add complexity to the design of the outer zones making manufacturing of the carrier head more difficult.

A retaining ring is secured to the carrier head to retain the semiconductor substrate and improve the resulting finish and flatness of the substrate surface (e.g., by minimizing the edge effect). The retaining ring has a bottom surface for contacting the polishing pad during polishing and a top surface which is secured to the carrier head. The bottom surface can pre-compress the polishing pad to move a high-pressure region at the leading edge off the substrate. The bottom surface includes a plurality of grooves to facilitate transport of a polishing slurry from outside the retaining ring to the substrate even when the bottom surface is contacting the polishing pad. Existing retaining rings have a fixed number of grooves, fixed groove shape, and fixed groove dimensions making it difficult to improve and/or optimize slurry intake and retention within the ring during processing. As existing retaining rings wear down with normal use, groove height will be reduced, which causes the amount of slurry intake and retention to gradually change over time. Existing retaining ring designs can also suffer from a scraping effect, which can increase overall slurry consumption. Thus, existing designs exhibit pronounced shortcomings with respect to slurry use, and since slurry is an expensive aspect of CMP process, it is desirable to lower overall slurry consumption by reducing waste.

Therefore, there is a need for an apparatus and method to overcome the problems described above.

SUMMARY

Embodiments of the present disclosure generally relate to an apparatus and method for polishing and/or planarization of substrates. More particularly, embodiments of the disclosure relate to retaining assemblies for carrier heads utilized for chemical mechanical polishing (CMP).

In one embodiment, a retaining ring assembly is configured to be attached to a carrier head. The retaining ring assembly includes a retaining ring including a lower surface, an inner surface, an outer surface and a plurality of grooves, where the lower surface is configured to contact a polishing pad during a polishing process, and each of the plurality of grooves are formed in the lower surface and extend from the inner surface to the outer surface. The retaining ring assembly includes a plurality of retainers, each retainer including a movable tooth at least partially disposed in a respective groove of the retaining ring and moveable relative to the lower surface.

In another embodiment, a system for polishing a substrate includes a housing including a plurality of stationary magnets, a carrier head disposed adjacent to the housing, and a retaining ring assembly attached to the carrier head. The retaining ring assembly includes a retaining ring including a lower surface, an inner surface, an outer surface and a plurality of grooves, where the lower surface is configured to contact a polishing pad during a polishing process, and each of the plurality of grooves are formed in the lower surface and extend from the inner surface to the outer surface. The retaining ring assembly includes a movable magnet disposed within a magnetic field of a first stationary magnet of the plurality of stationary magnets. The retaining ring assembly includes a movable tooth coupled to the movable magnet and disposed within a groove of the plurality of grooves.

In yet another embodiment, a method for polishing a substrate includes disposing the substrate in a polishing system. The polishing system includes a housing including a plurality of stationary magnets, a carrier head disposed adjacent to the housing, and a retaining ring assembly attached to the carrier head. The retaining ring assembly includes a retaining ring including a lower surface, an inner surface, an outer surface and a plurality of grooves, where the lower surface is configured to contact a polishing pad during a polishing process, and each of the plurality of grooves are formed in the lower surface and extend from the inner surface to the outer surface. The retaining ring assembly includes a movable magnet and a movable tooth coupled to the movable magnet and disposed within a groove of the plurality of grooves. The method includes rotating the carrier head to a first angular position relative to the housing, where the retainer has a first vertical position when the carrier head is in the first angular position and rotating the carrier head to a second angular position relative to the housing, where the second angular position is different from the first angular position, and where the retainer moves to a second vertical position different from the first vertical position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Before describing several exemplary embodiments of the apparatus and methods, it is to be understood that the disclosure is not limited to the details of construction or process steps set forth in the following description. It is envisioned that some embodiments of the present disclosure may be combined with other embodiments.

One or more embodiments of the present disclosure are directed towards an apparatus and method for polishing and/or planarization of substrates, such as semiconductor substrates. In some embodiments, a system may comprise a stationary housing including a plurality of stationary magnets, a carrier head disposed adjacent to the stationary housing, and a retainer movably attached to the carrier head. In some embodiments, the retainer may include a movable magnet disposed within a magnetic field of a first stationary magnet of the plurality of stationary magnets and a movable tooth fixedly attached to the movable magnet. In one or more embodiments, as the carrier head rotates, the movable magnet can align with the first stationary magnet causing the movable magnet to move relative to the first stationary magnet.

In one or more embodiments, a gap between a bottom surface of the movable tooth and a polishing pad is configured to convey a polishing slurry. In one or more embodiments, the gap between each movable tooth and the polishing pad can be adjusted to precisely control transport of polishing slurry to and from a substrate being polished. For example, retaining assemblies at a trailing edge of the carrier head may be lowered to restrict polishing slurry from exiting the retaining ring holding the substrate while retaining assemblies at a leading edge of the carrier head may be raised to admit fresh polishing slurry to the substrate. Precise control of polishing slurry transport can reduce overall consumption of the polishing slurry.

Conventional CMP processes can have high polishing rates at the edge of the substrate caused by deflection and rebound of the pad resulting in non-uniform pressure being applied by the pad to all regions of to be polished surface of the substrate. However, in one or more other embodiments of the present disclosure, a downforce of each movable tooth of the retaining ring assembly on the polishing pad can be independently controlled. Independent control of downforce can improve wafer edge uniformity and profile (e.g., by reducing and/or eliminating non-uniformity at the edge caused by high polishing rates), and independent control of downforce can also enable simplified membrane design (e.g., in outer zones 1 and 2).

Figure 1:
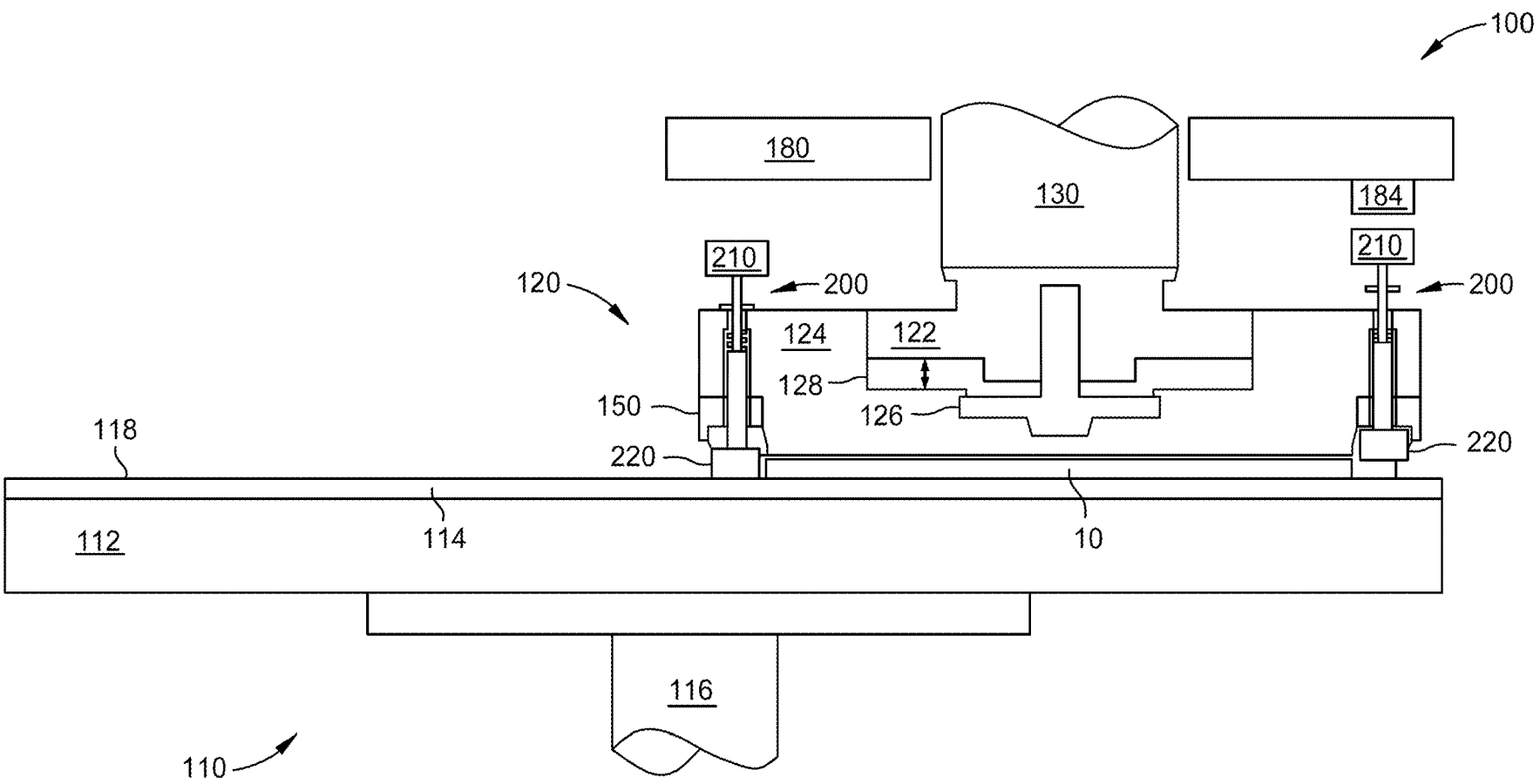
FIG. 1 is a schematic side sectional view of a polishing system according to one or more embodiments.

FIG. 1 is a schematic side sectional view of a polishing system 100 according to one or more embodiments. Polishing systems that may be adapted to benefit from the present disclosure include MIRRA®, MIRRA MESA®, REFLEXION®, REFLEXION® GT, REFLEXION® LK, and REFLEXION® LK PRIME Planarizing Systems, all available from Applied Materials, Inc. of Santa Clara, Calif., among others.

The polishing system 100 generally comprises a polishing station 110, a carrier head 120, a retaining ring 150, and a housing 180. The housing 180 includes one or more stationary magnets 184. In addition, the polishing system 100 also includes one or more retaining assemblies 200 movably attached to the carrier head 120 and/or the retaining ring 150. Each of the retaining assemblies 200 includes a movable magnet 210 and a movable tooth 220. In at least one embodiment, the polishing system 100 has a single polishing station 110. In another embodiment, the polishing system 100 includes multiple polishing stations 110 and multiple carrier heads 120. For example, the polishing station 110 may be disposed on a system base having multiple platens and the carrier head 120 may be supported by a rotatable carousel having multiple carrier heads identical or similar to the carrier head 120. In some embodiments, the carrier head 120 may move a substrate 10 from one polishing station 110 to another polishing station configured to perform a different polishing step to the substrate 10. In one or more embodiments, the housing 180 may be an upper pneumatics assembly (UPA).

The polishing station 110 generally comprises a rotatable platen 112 on which a polishing pad 114 is placed. The rotatable platen 112 and the polishing pad 114 are generally larger than a semiconductor substrate 10 being processed. In at least one embodiment, the platen 112 is a rotatable aluminum plate connected by a aluminum drive shaft 116 to a platen drive motor (not shown), which rotates the platen 112 and polishing pad 114 during processing. In one or more embodiments, the platen 112 may be directly or indirectly driven by the platen drive motor.

The polishing pad 114 has a roughened polishing surface 118 configured to polish the substrate 10. In at least one embodiment, the polishing pad 114 may be attached to the platen 112 by a pressure-sensitive adhesive layer. The polishing pad 114 is generally consumable and may be replaced.

The polishing station 110 may further comprise a polishing composition supply tube (not shown) configured to provide a polishing composition (e.g., slurry) to the polishing pad 114. The polishing composition generally contains a reactive agent, abrasive particles, and a chemical-reactive catalyzer. In one or more embodiments, a chemistry of the polishing composition may depend on the type of CMP process being performed. In some embodiments, the polishing composition can be or include a basic chemistry for planarizing oxide layers (e.g., dielectrics). For example, a basic polishing composition may include deionized water, metal oxide powder, and potassium hydroxide. In addition, CMP processes performed on oxide layers are primarily mechanically driven, whereby control of downforce (e.g., pressure applied to the substrate during polishing) is a primary polishing rate and uniformity control mechanism.

In some other embodiments, the polishing composition can be or include an acidic chemistry for planarizing metal layers. For example, an acidic polishing composition may include deionized water, metal oxide power, and carboxylic acid. In addition, CMP processes performed on metal layers are primarily chemically driven, whereby control of slurry intake and retention is a primary polishing rate and uniformity control mechanism. Therefore, use of one or more of the apparatus and methods disclosed herein can be especially advantageous for use in metal CMP polishing processes.

The polishing station 110 may further comprise a pad conditioner (not shown) configured to maintain the polishing pad 114 in a state that effectively polishes the substrate 10. In at least one embodiment, the pad conditioner may comprise a rotatable arm holding an independently rotating conditioner head.

The carrier head 120 is suspended from and/or positioned below the housing 180. The carrier head 120 is generally configured to press the substrate 10 against the polishing pad 114 during polishing. In one example, the carrier head 120 includes a housing 122, a base assembly 124, and a gimbal 126. The base assembly 124 is vertically movable with respect to the housing 122 and together therewith defines a loading chamber 128. The vertical position of the base assembly 124 relative to the polishing pad 114 may be controlled by changing the pressure within the loading chamber 128. For example, the loading chamber 128 is typically pressurized during polishing to exert a downward force on the base assembly 124 which brings the retaining ring 150 into contact with the polishing pad 114. Before and after polishing, the pressure in the loading chamber 128 is reduced and/or a vacuum is applied to the loading chamber 128 so that the base assembly 124, is moved and/or pulled upward and away from the polishing pad 114. Once the base assembly 124 is moved upward and away from the polishing pad 114, the carrier head 120 may be moved, e.g., swung, away therefrom, such as to a second polishing platen (not shown) and/or to a substrate loading station, e.g., a load cup (not shown), for subsequent polishing and/or substrate loading/unloading handling operations respectively.

The housing 122 is generally circular in shape and can be connected to a spindle 130 to rotate and/or sweep then carrier head 120 across the polishing pad 114 during polishing. The base assembly 124 is a vertically movable assembly located beneath the housing 122. The gimbal 126 slides vertically to provide a vertical motion of the base assembly 124. The gimbal 126 also permits the base assembly 124 to pivot with respect to the housing 122 so that the retaining ring 150 may remain substantially parallel with the polishing surface 118 of the polishing pad 114.

Figure 2B:
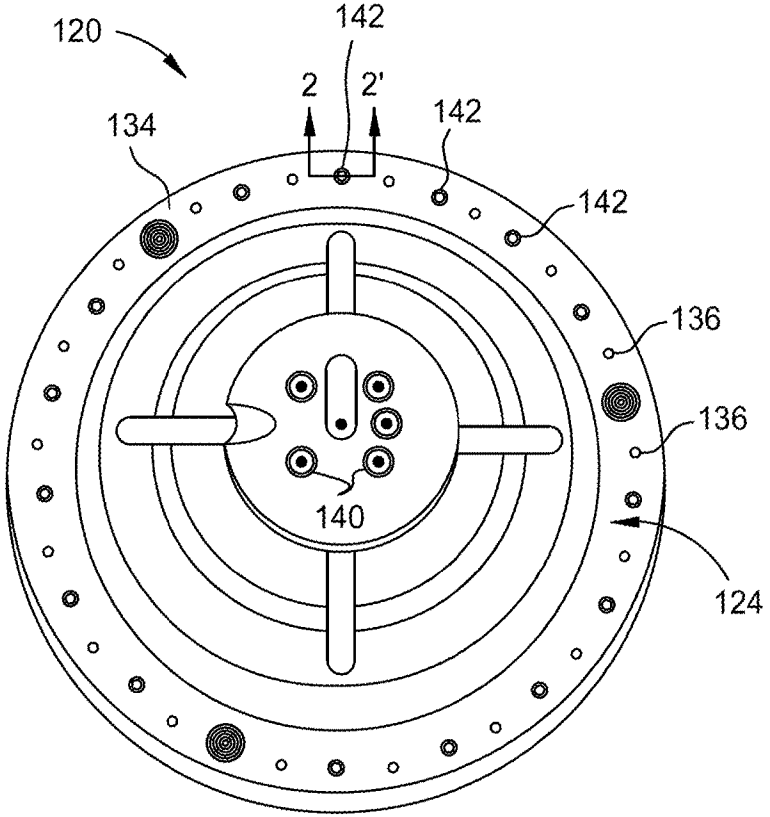
FIG. 2B is a perspective view of one embodiment of a carrier head of the present disclosure.
Figure 2C:
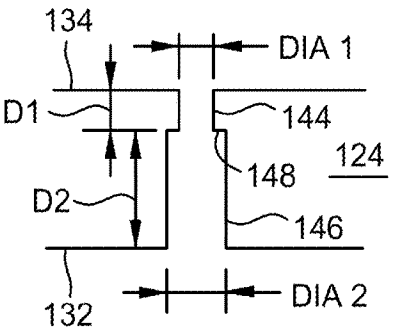
FIG. 2C is an enlarged sectional view taken along section line 2-2' of FIG. 2B.
Figure 2A:
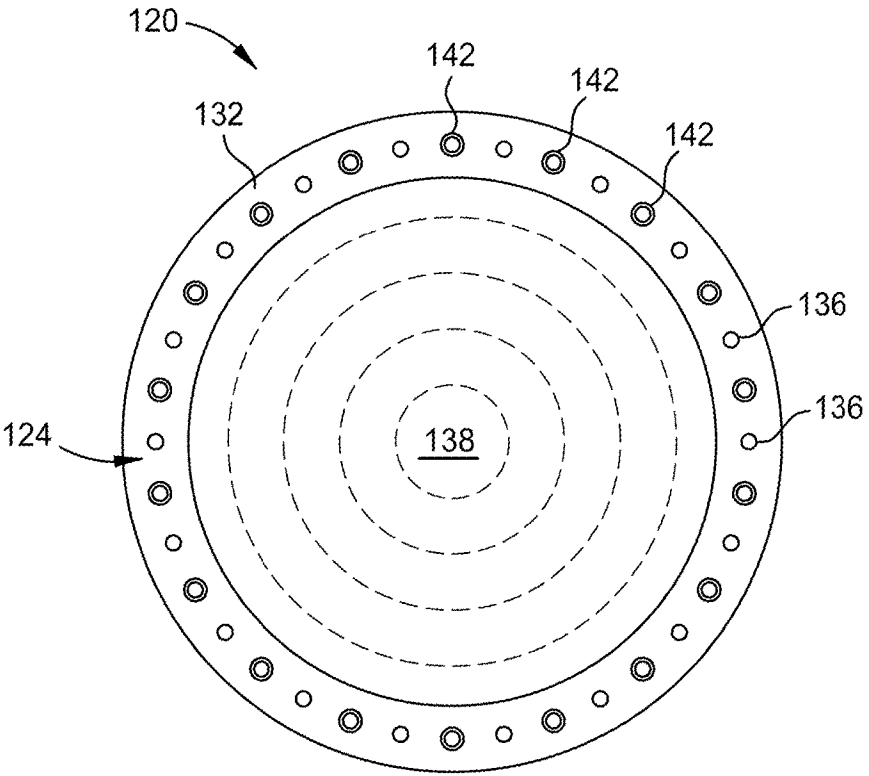
FIG. 2A is a bottom view of one embodiment of a carrier head of the present disclosure.

FIG. 2A is a bottom view of one embodiment of a carrier head 120 of the present disclosure. FIG. 2B is a perspective view of one embodiment of a carrier head 120 of the present disclosure. Referring to FIGS. 2A-2B, the base assembly 124 of the carrier head 120 includes a bottom surface 132, a top surface 134, and a plurality of screw holes 136 for receiving a plurality of fasteners (e.g., machine screws) to attach the retaining ring 150 to the carrier head 120. In the example depicted in FIGS. 2A-2B, the carrier head 120 has 18 screw holes, such that the screw holes 136 are evenly spaced by a radial angle of 20 degrees. In some other embodiments, the carrier head 120 may have a lower or higher number of screw holes 136, such as from 6 to 24, such as from 6 to 12, alternatively from 12 to 18, alternatively from 18 to 24. The screw holes 136 may have uniform or non-uniform spacing.

The carrier head 120 includes a membrane 138 that contacts the substrate 10 (e.g., the membrane 138 illustrated in FIG. 2A includes 5 concentric zones shown in phantom). Pressure applied to a chamber bounded by the backside of the membrane 138 may be selected to control the center to edge profile of force applied by the membrane 138 to the substrate 10, and consequently, to control the center to edge profile of force applied by the substrate 10 against the polishing pad 114. The membrane 138 may also be used to chuck the substrate 10 to the carrier head 120 before and after polishing. For example, before and after polishing, a vacuum may be applied to the chamber so that the membrane 138 is deflected upwards to create a low pressure pocket between the membrane 138 and the substrate 10, thus vacuum-chucking the substrate 10 into the carrier head 120.

The carrier head 120 includes a plurality of pneumatic ports 140 for supplying pressurized air to respective chambers of the carrier head 120 (e.g., 5 pneumatic ports 140 are illustrated in FIG. 2B corresponding to each of the 5 zones). The pressure within the chambers are utilized to control the pressure applied to the membrane 138, move the base assembly 124, and to displace the retaining ring 150.

The carrier head 120 includes a plurality of thru-holes 142, each thru-hole 142 being configured to receive a retainer 200. In one or more embodiments, the thru-holes 142 may be disposed on a common radius. In some embodiments, the thru-holes 142 may be formed by drilling, machining, or other suitable technique. In some embodiments, the thru-holes 142 may be evenly spaced between adjacent screw holes 136. In one or more embodiments, the thru-holes 142 may be evenly spaced by a radial angle of 20 degrees.

FIG. 2C is an enlarged sectional view taken along section line 2-2' of FIG. 2B. Referring to FIG. 2C, each thru-hole 142 may include an upper portion 144 having a diameter DIA1 and a lower portion 146 having a diameter DIA2. In some embodiments, the diameter DIA1 is less than the diameter DIA2, and a shoulder 148 is formed between the upper and lower portions 144, 146. In some embodiments, the diameters DIA1, DIA2 may be about equal. The upper portion 144 may have a depth D1, measured from the top surface 134 to the shoulder 148, of from about 5 mm to about 40 mm, such as from about 10 mm to about 20 mm. The lower portion 146 may have a depth D2 measured from the bottom surface 132 to the shoulder 148, of from about 10 mm to about 60 mm, such as from about 20 mm to about 40 mm.

Figure 3A:
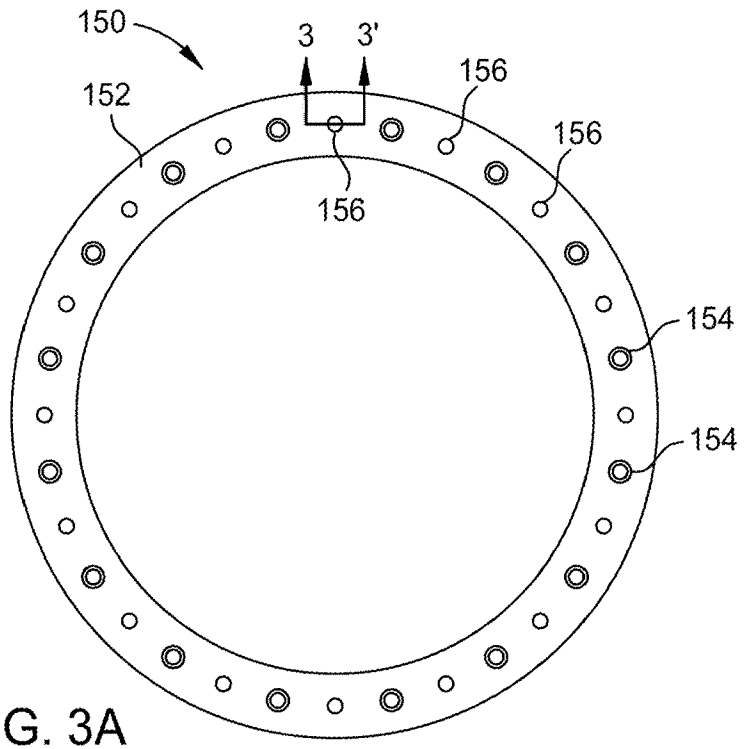
FIG. 3A is a top view of one embodiment of a retaining ring of the present disclosure.

FIG. 3A is a top view of one embodiment of a retaining ring 150 of the present disclosure. The retaining ring 150 is generally an annular ring removably attached and circumscribing the base assembly 124. When fluid is pumped into the loading chamber 128, the base assembly 124 and retaining ring 150 are pushed down to apply a load to the polishing pad 114. In at least one embodiment, the retaining ring 150 may be a one-part ring. In some other embodiments, the retaining ring 150 may be a multi-part ring, for example, comprising upper and lower portions which are coupled together, for example utilizing at least one of adhesives or fasteners.

The retaining ring 150 comprises a top surface 152 having a plurality of blind-holes 154 having internal threads for receiving a plurality of fasteners (e.g., machine screws) to attach the retaining ring 150 to the carrier head 120. The top surface 152 contacts the bottom surface 132 of the carrier head 120 when the retaining ring 150 is installed on the carrier head 120. The top surface 152 can comprise stainless steel, molybdenum, aluminum, other suitable metals, composites, and plastics, among other suitable material. The blind-holes 154 can be spaced by a radial angle $\alpha 0$. In some embodiments, the radial angle $\alpha 0$ can be from about 15 degrees to about 60 degrees, such as about 15 degrees, alternatively about 20 degrees, alternatively about 30 degrees, alternatively about 60 degrees. In the example depicted in FIG. 3A, the retaining ring 150 has 18 blind-holes formed in the top surface 152, such that the blind-holes 154 are evenly spaced by a radial angle of 20 degrees. In some other embodiments, the retaining ring 150 may have a lower or higher number of blind-holes 154, such as from 6 to 24, such as from 6 to 12, alternatively from 12 to 18, alternatively from 18 to 24. The blind-holes 154 may have uniform or non-uniform spacing.

The retaining ring 150 includes a plurality of thru-holes 156 formed in the top surface 152, each thru-hole 156 being configured to receive a retainer 200. In one or more embodiments, the thru-holes 156 may be disposed on a common radius. In some embodiments, the thru-holes 156 may be formed by drilling, machining, or other suitable technique. In some embodiments, the thru-holes 156 may be evenly spaced between adjacent blind-holes 154. In one or more embodiments, the thru-holes 156 may be evenly spaced by a radial angle of 20 degrees. In one or more embodiments, each thru-hole 156 of the retaining ring 150 is aligned with a respective thru-hole 142 of the carrier head 120 when the retaining ring 150 is installed on the carrier head 120.

Figure 3B:
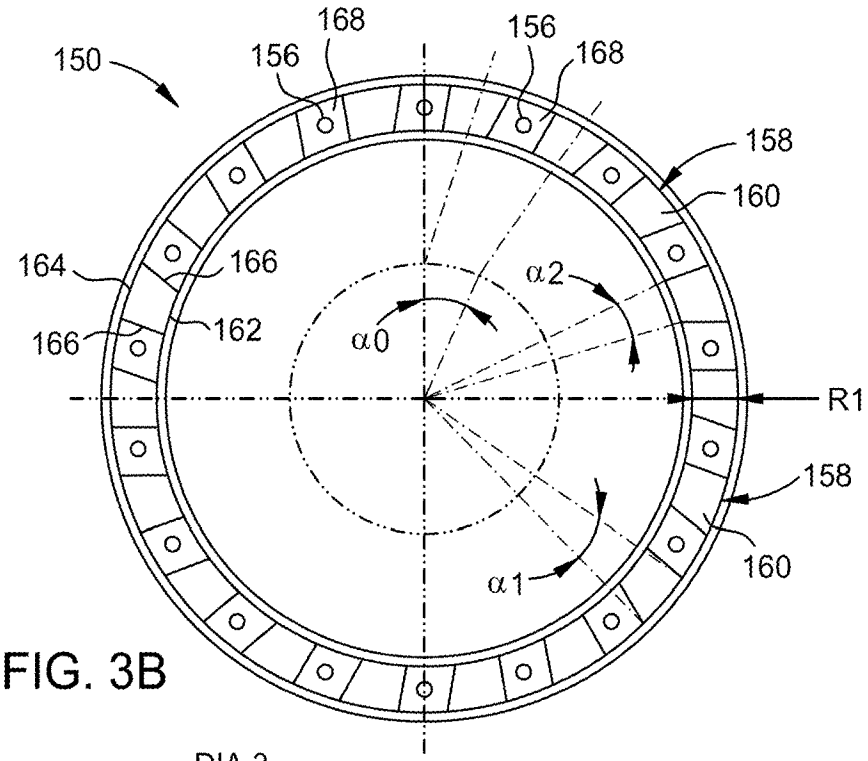
FIG. 3B is a bottom view of one embodiment of a retaining ring of the present disclosure.
Figure 3C:
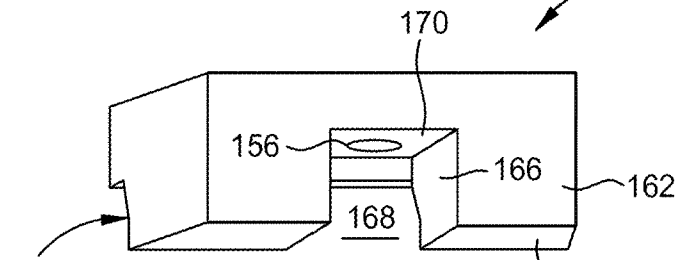
FIG. 3C is a perspective view of one embodiment of a retaining ring of the present disclosure.

FIG. 3B is a bottom view of one embodiment of a retaining ring 150 of the present disclosure. FIG. 3C is a perspective view of one embodiment of a retaining ring 150 of the present disclosure. Referring to FIGS. 3B and 3C, the retaining ring 150 includes a plurality of fixed teeth 158, each having a bottom surface 160 configured to contact the polishing pad 114. In some embodiments, the plurality of fixed teeth 158 may contact the polishing pad 114. In some other embodiments, the plurality of fixed teeth 158 may be spaced from the polishing pad 114. The bottom surface 160 can comprise polyphenylene sulfide (PPS), polyether ether ketone (PEEK), polyethylene terephthalate (PET), or combinations thereof. In embodiments wherein the retaining ring 150 is a one-part ring, the entire retaining ring 150 comprises the same plastic material exposed on the bottom surface 160 of the retaining ring 150. In some other embodiments as discussed above, the retaining ring 150 may be a two-part ring having upper and lower portions comprising different materials. In some embodiments, the bottom surface 160 may be substantially planar for evenly contacting the polishing pad 114.

Each of the plurality of fixed teeth 158 has an inner surface 162 facing toward a centerline of the retaining ring 150 and an outer surface 164 opposite the inner surface 162. In some embodiments, the inner and outer surfaces 162, 164 may be curved surfaces matching the curvature of the retaining ring 150. In some other embodiments, the inner and outer surfaces 162, 164 may be straight. In some embodiments, a radial distance R1 between the inner and outer surfaces 162, 164 may be from about 5 mm to about 50 mm, such as from about 20 mm to about 30 mm. Each of the plurality of fixed teeth 158 has first and second lateral surfaces 166. In some embodiments, the first and second lateral surfaces 166 may be non-parallel as shown in FIGS. 3B and 3C. In one or more embodiments, the first and second lateral surfaces 166 may diverge from each other moving from the inner surface 162 to the outer surface 164. In one or more other embodiments, the first and second lateral surfaces 166 may converge toward each other moving from the inner surface 162 to the outer surface 164. In some other embodiments, the first and second lateral surfaces 166 may be parallel to each other.

In one or more embodiments, the retaining ring 150 can include from about 6 to about 24 fixed teeth, such as from about 12 to about 18 fixed teeth. In some other embodiments, the retaining ring 150 can include about 12 fixed teeth or less, such as from about 6 to about 12 fixed teeth. In some other embodiments, the retaining ring 150 can include about 18 fixed teeth or more, such as from about 18 to about 24 fixed teeth.

In some embodiments, a maximum arc length α1 of each of the fixed teeth 158 (i.e., a central angle corresponding to a maximum arc length selected from the group of arc lengths between the inner surface 162 and the outer surface 164 of each of the fixed teeth 158) may be from about 10 degrees to about 20 degrees, such as from about 10 degrees to about 15 degrees, alternatively from about 15 degrees to about 20 degrees. In some other embodiments, the maximum arc length α1 of each of the fixed teeth 158 may be from about 1 degree to about 10 degrees, such as from about 1 degree to about 5 degrees, alternatively from about 5 degrees to about 10 degrees. In some other embodiments, the maximum arc length α1 of each of the fixed teeth 158 may be from about 20 degrees to about 30 degrees, such as from about 20 degrees to about 25 degrees, alternatively from about 25 degrees to about 30 degrees.

In some embodiments, a minimum arc length α2 of each of the fixed teeth 158 may be from about 10 degrees to about 20 degrees, such as from about 10 degrees to about 15 degrees. In some other embodiments, the minimum arc length α2 of each of the fixed teeth 158 may be from about 5 degrees to about 10 degrees.

A plurality of grooves 168 are formed between opposing first and second lateral surfaces 166 of adjacent fixed teeth 158, wherein the plurality of grooves 168 are configured to convey a polishing slurry from outside the retaining ring 150 to the substrate 10. The groove 168 includes a shoulder 170 intersecting a respective one of the thru-holes 156. Each of the grooves 168 may be aligned with a respective one of the thru-holes 156. In one or more embodiments, each thru-hole 156 may be evenly spaced between the lateral surfaces 166. In some other embodiments, each thru-hole 156 may be offset relative to the lateral surfaces 166.

Figure 3D:
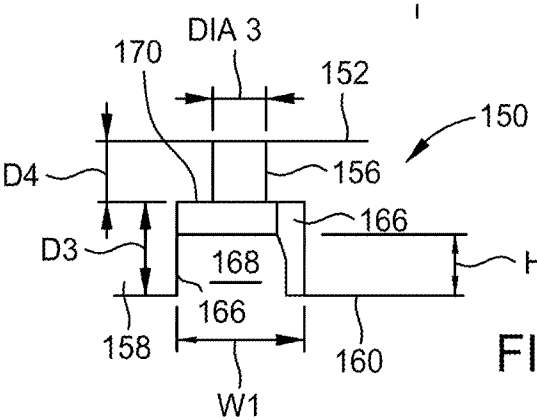
FIG. 3D is an enlarged sectional view taken along section line 3-3' of FIG. 3A.

FIG. 3D is an enlarged sectional view taken along section line 3-3' of FIG. 3A. Referring to FIG. 3D, a height H1 of each of the fixed teeth 158 may be from about 3 mm to about 30 mm, such as from about 3 mm to about 20 mm, such as from about 6 mm to about 12 mm. In some embodiments, a width W1 of the groove 168 between the first and second lateral surfaces 166 can be selected based on the dimensions and spacing of the fixed teeth 158. In one or more embodiments, the width W1 may be from about 3 mm to about 50 mm, such as from about 5 mm to about 25 mm, such as from about 5 mm to about 20 mm, such as from about 5 mm to about 10 mm. In some embodiments, a depth D3 of the groove 168 measured from the bottom surface 160 to the shoulder 170 can be about 2× the height H1 of each of the fixed teeth 158 or greater, such as from about 6 mm to about 60 mm, such as from about 6 mm to about 40 mm, such as from about 12 mm to about 24 mm. In one or more embodiments, the thru-hole 156 may have a depth D4 measured from the top surface 152 of the retaining ring 150 to the shoulder 170 based on total height of the retaining ring 150 and the depth D3 of the groove 168, such as from about 5 mm to about 50 mm, such as from about 10 mm to about 30 mm. In some embodiments, the thru-hole 156 may have a diameter DIA3 about equal to the diameter DIA2 of the lower portion 146 of the thru-hole 142 in the carrier head 120. In some embodiments, the diameter DIA3 may be less than the width W1. In some other embodiments, the diameter DIA3 and the width W1 may be about equal.

Figure 4B:
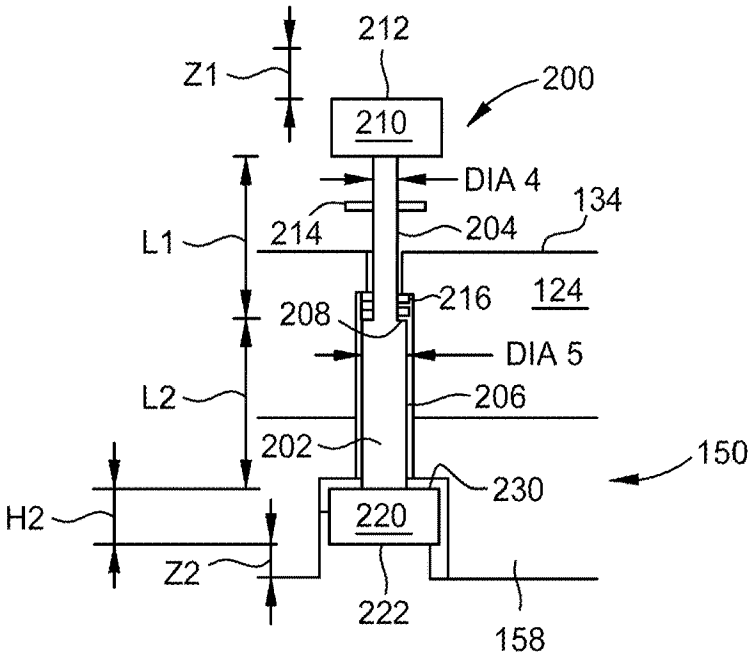
FIG. 4B is a sectional view taken along section line 4-4' of FIG. 4A.
Figure 4A:
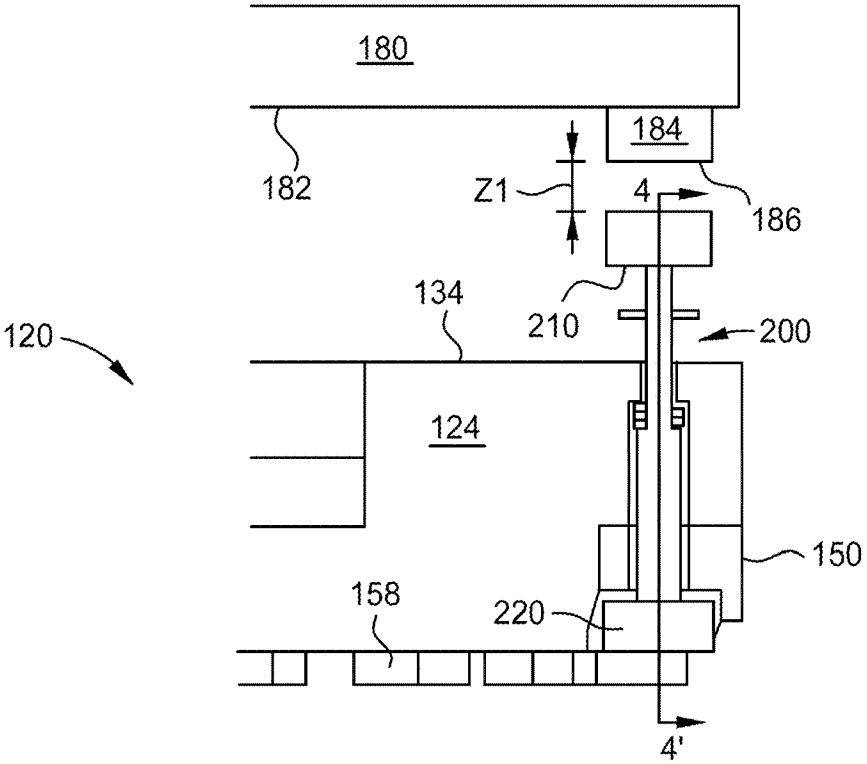
FIG. 4A is an enlarged sectional view of a portion of the polishing system of FIG. 1 showing an embodiment of a retainer installed therewith.

FIG. 4A is an enlarged sectional view of a portion of the polishing system 100 of FIG. 1 showing an embodiment of a retainer 200 installed therewith. Referring to FIG. 4A, the housing 180 has a bottom surface 182. In some embodiments, the bottom surface 182 may be a horizontal surface facing the top surface 134 of the carrier head 120. One or more stationary magnets 184 may be attached to the bottom surface 182. In some embodiments, the stationary magnets 184 may be rigidly attached directly to the bottom surface 182 of the housing 180 by adhesives and/or fasteners. In some other embodiments, the stationary magnets 184 may be attached to the housing 180 by a bracket, an adapter, or another structure to position the stationary magnets 184 vertically and/or radially. In some embodiments, the stationary magnets 184 may be permanent magnets, such as neodymium magnets, electromagnets, or combinations thereof. In one or more embodiments, the stationary magnets 184 can be or include ferromagnetic materials. In one or more embodiments, the ferromagnetic materials may include iron, nickel, cobalt, or combinations thereof. In some embodiments, the ferromagnetic materials may be in the form of a coating over a non-magnetic or magnetic material. Thus, the stationary magnets 184 can be defined as any magnetic material including permanent magnets, electromagnets, or ferromagnetic materials. As shown, the stationary magnets 184 have a bottom surface 186 facing the top surface 134 of the carrier head 120. The stationary magnets 184 can have any suitable size and shape depending on a vertical clearance between the housing 180 and the carrier head 120 and other spatial constraints. In one or more embodiments, the stationary magnets 184 may be cylindrical having a diameter of from about 5 mm to about 25 mm, such as from about 10 mm to about 20 mm, and a height of from about 2 mm to about 10 mm, such as from about 2 mm to about 5 mm, alternatively from about 5 mm to about 10 mm.

FIG. 4B is a sectional view taken along section line 4-4' of FIG. 4A. Referring to FIGS. 4A-4B, the retainer 200 may be one of a plurality of retaining assemblies installed in the polishing system 100. The plurality of retaining assemblies may be aligned along a common radius relative to the centerline of the carrier head 120. The retainer 200 includes a shaft 202 movably coupling the retainer 200 to the carrier head 120. The shaft 202 can include an upper portion 204 and a lower portion 206. The retainer 200 can include a movable magnet 210 attached to the upper portion 204 of the shaft 202 and a movable tooth 220 attached to the lower portion 206 of the shaft 202. In some embodiments, a diameter DIA4 of the upper portion 204 is less than a diameter DIA5 of the lower portion 206, and a shoulder 208 may be formed between the upper and lower portions 204, 206. In some other embodiments, the diameters DIA4, DIA5 may be about equal. The diameters DIA4, DIA5 may be selected based on the diameters DIA1, DIA2 of the upper portion 144 and the lower portion 146, respectively, of the thru-hole 142 in the carrier head 120. In one or more embodiments, the diameters DIA4, DIA5 may be selected to provide a suitable radial clearance between the shaft 202 and the thru-hole 142.

The upper portion 204 may have a length L1, measured from the shoulder 208 to the movable magnet 210, selected based on one or more of the depth D1 of the upper portion 144 of the thru-hole 142 in the carrier head 120, the vertical clearance between the carrier head 120 and the housing 180, the height of the stationary magnets 184, a working distance between the movable magnet 210 and one or more of the stationary magnets 184, or combinations thereof. In one or more embodiments, the length L1 may be from about 10 mm to about 60 mm, such as from about 30 mm to about 60 mm. The lower portion 206 may have a length L2, measured from the shoulder 208 to the movable tooth 220, selected based on one or more of the depth D2 of the lower portion 146 of the thru-hole 142 in the carrier head 120, the depth D4 of the thru-hole 156 in the retaining ring 150, a height H2 of the movable tooth 220, a gap between the fixed tooth and the polishing pad 114, or combinations thereof. In one or more embodiments, the length L2 may be from about 10 mm to about 60 mm, such as from about 30 mm to about 60 mm.

In some embodiments, the movable magnet 210 attached to the upper portion 204 of the shaft 202 is at least partially disposed above the top surface 134 of the carrier head 120, such that the movable magnet 210 may be vertically positioned within a magnetic field of one or more of the stationary magnets 184 attached to the housing 180. In some embodiments, the movable magnet 210 may be any suitable permanent magnet, such as a neodymium magnet. In some alternative embodiments, the movable magnet 210 can be or include a ferromagnetic material. In one or more embodiments, the ferromagnetic material may include iron, nickel, cobalt, or combinations thereof. In some embodiments, the ferromagnetic material may be in the form of a coating over a non-magnetic or magnetic material. Thus, the movable magnet 210 can be defined as any magnetic material including permanent magnets or ferromagnetic materials. Some suitable ferromagnetic materials can be or include iron, nickel, cobalt, or combinations thereof. The movable magnet 210 can have any suitable size and shape depending on a vertical clearance between the stationary magnets 184 and the carrier head 120 and other spatial constraints. In some embodiments, the size and shape of the movable magnet 210 may match the size and shape of the stationary magnets 184, such that the corresponding magnetic fields may be aligned. In one or more embodiments, the movable magnet 210 may be cylindrical having a diameter of from about 5 mm to about 25 mm, such as from about 10 mm to about 20 mm, and a height of from about 2 mm to about 10 mm, such as from about 2 mm to about 5 mm, alternatively from about 5 mm to about 10 mm. The movable magnet 210 may have a top surface 212 facing one or more of the stationary magnets 184. In some embodiments, a distance Z1, measured between the top surface 212 of the movable magnet 210 and the bottom surface 186 of one or more of the stationary magnets 184, may be about 20 mm or less, such as about 10 mm or less, such as from about 1 mm to about 10 mm, such as from about 1 mm to about 5 mm.

In some embodiments, a lower stop shoulder 214 may be formed on the upper portion 204 of the shaft 202. In one or more embodiments, contact between the lower stop shoulder 214 and the top surface 134 of the carrier head 120 can limit downward movement of the retainer 200. In one or more embodiments, a spring 216 may be disposed between shoulder 148 of the carrier head 120 and the shoulder 208 of the retainer 200 to bias the retainer toward a lower position. In some embodiments, the spring 216 can be or include any suitable compression spring (e.g., a coil spring or flat spring). In some other embodiments, the spring 216 may be omitted and the retainer 200 may be biased to the lower position by gravity.

In some embodiments, the retainer 200 may start in the lower position under the downward bias force with the lower stop shoulder 214 contacting the top surface 134 as shown on the left side of FIG. 1. In the lower position, the distance Z1 may be from about 10 mm to about 20 mm, such as about 10 mm to about 15 mm. During rotation, when the retainer 200 passes under one or more of the stationary magnets 184, a magnetic force of attraction between the movable magnet 210 and one or more of the stationary magnets 184 may lift the retainer 200 to an upper position as shown in FIG. 4A. In the upper position, the distance Z1 may be from about 1 mm to about 10 mm, such as from about 1 mm to about 5 mm. In some other embodiments, the retainer 200 may be lifted to an intermediate position between the lower and upper positions. In the intermediate position, the distance Z1 may be from about 3 mm to about 15 mm, such as from about 5 mm to about 12 mm.

In some embodiments, a height H2 of the movable tooth 220, measured from the bottom surface 222 to an opposing top surface 230 may be about equal to a height H1 of each of the fixed teeth 158 or greater, such as from about 3 mm or greater, such as from about 3 mm to about 60 mm, such as from about 3 mm to about 30 mm. In some embodiments, the movable tooth 220 may be fixedly attached to the lower portion of the shaft 202. In some embodiments, the movable tooth 220 is at least partially disposed in the groove 168 of the retaining ring 150, such that vertical movement of the movable tooth 220 may adjust a gap Z2 between a bottom surface 222 of the movable tooth 220 and the polishing pad 114. In some embodiments, a stroke length of the movable tooth 220 may be about 20 mm or less, such as from about 3 mm to about 20 mm, such as from about 5 mm to about 12 mm. In some embodiments, the stroke length may be about 10 mm or less, such as about 7 mm or less. In some embodiments, the gap Z2 in the lower position of the retainer 200 is equal to about 0 mm. In some embodiments, the gap Z2 in the upper position of the retainer 200 may be from about 3 mm to about 20 mm, such as from about 5 mm to about 12 mm, such as from about 7 mm to about 10 mm, such as about 7 mm. In some embodiments, the gap Z2 in the intermediate position of the retainer 200 can about 15 mm or less, such as about 10 mm or less, such as from about 0 mm to about 10 mm, such as from about 1 mm to about 9 mm, alternatively from about 0 mm to about 7 mm, such as from about 1 mm to about 6 mm.

In some embodiments, the gap Z2 may be controlled to control polishing slurry intake. For example, increasing or decreasing the gap Z2 on a leading edge 190 of the retaining ring 150 can increase or decrease, respectively, a cross-sectional flow area for conveying the polishing slurry from outside the retaining ring 150 to the substrate 10. In some embodiments, the gap Z2 may be controlled to control polishing slurry retention. For example, increasing or decreasing the gap Z2 on a trailing edge 192 of the retaining ring 150 can increase or decrease, respectively, a cross-sectional flow area for conveying the polishing slurry from the substrate 10 to outside the retaining ring 150. In some embodiments, the cross-sectional area is linearly proportional to the gap Z2. In some embodiments, a maximum volume of polishing slurry can be conveyed through the grooves 168 when the retainer 200 is in the upper position. Likewise, a minimum volume of polishing slurry can be conveyed through the grooves 168 when the retainer 200 is in the lower position.

Figure 4D:
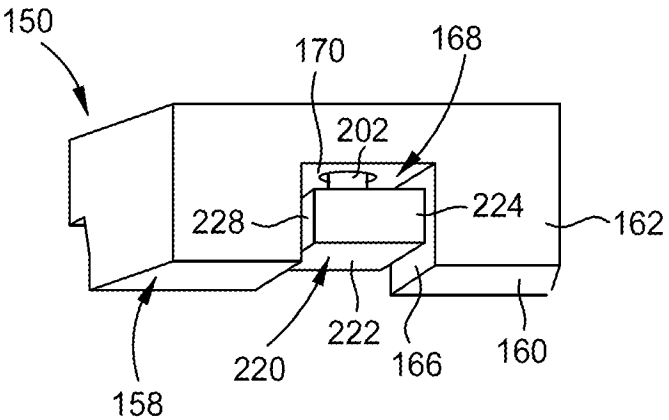
FIG. 4D is a perspective view of one embodiment of a retaining ring showing a movable tooth disposed therein.
Figure 4C:
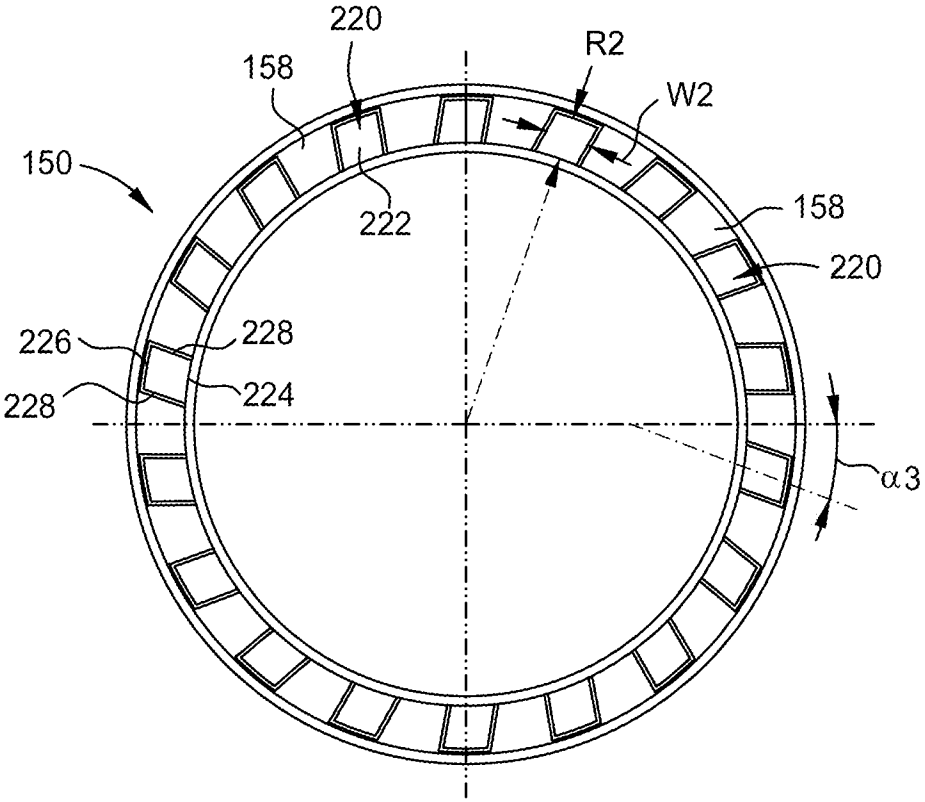
FIG. 4C is a bottom view of one embodiment of a retaining ring showing a plurality of movable teeth disposed therein.

FIG. 4C is a bottom view of one embodiment of a retaining ring 150 showing a plurality of movable teeth 220 disposed therein. FIG. 4D is a perspective view of one embodiment of a retaining ring 150 showing a movable tooth 220 disposed therein. Referring to FIGS. 4C and 4D, the movable teeth 220 may have a size and shape selected based on the dimensions and spacing of the plurality of fixed teeth 158. The bottom surface 222 can comprise polyphenylene sulfide (PPS), polyether ether ketone (PEEK), polyethylene terephthalate (PET), or combinations thereof. In some embodiments, the bottom surface 222 may be substantially planar for evenly contacting the polishing pad 114. Each movable tooth 220 has an inner surface 224 facing toward a centerline of the retaining ring 150 and an outer surface 226 opposite the inner surface 224. In some embodiments, the inner and outer surfaces 224, 226 may be curved surfaces matching the curvature of the retaining ring 150. In one or more embodiments, the inner and outer surfaces 224, 226 may be aligned with the inner and outer surfaces 162, 164, respectively, of each of the fixed teeth 158. In some other embodiments, the inner and outer surfaces 224, 226 may be straight. Each movable tooth 220 has first and second lateral surfaces 228. In some embodiments, the first and second lateral surfaces 228 may be parallel as shown in FIG. 4C. In some other embodiments, the first and second lateral surfaces 228 may be non-parallel. In some embodiments, the first and second lateral surfaces 228 may be curved. In one or more embodiments, the movable teeth 220 may be cylindrical. In one or more embodiments, the first and second lateral surfaces 228 may diverge from each other moving from the inner surface 224 to the outer surface 226. In one or more other embodiments, the first and second lateral surfaces 228 may converge toward each other moving from the inner surface 224 to the outer surface 226. In one or more embodiments, the first and second lateral surfaces 228 may match an angle of each adjacent lateral surface 166 of the adjacent fixed teeth 158. In some embodiments, an angle $\alpha 3$ of the first and second lateral surfaces 228 relative to square may be from about 30° to about 60°, such as from about 40° to about 60°, such as from about 40° to about 50°, such as about 45°, such as from about 45° to about 50°, such as about 50°.

In one or more embodiments, each movable tooth 220 may have a width W2 measured between the first and second lateral surfaces 228. In some embodiments, the width W2 may be selected to provide a suitable clearance between each of the first and second lateral surfaces 228 and lateral surfaces 166 of adjacent fixed teeth 158. In some embodiments, a radial distance R2 between the inner and outer surfaces 224, 226 may be about equal to the radial distance R1 between the inner and outer surfaces 162, 164 of each of the fixed teeth 158.

Figure 5A:
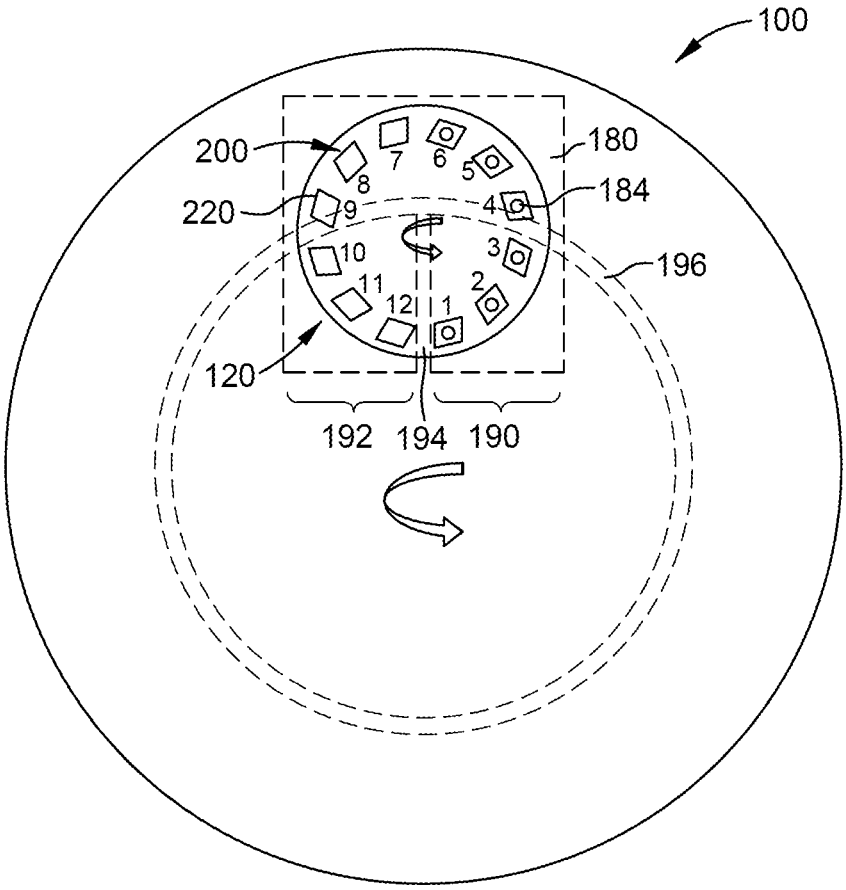
FIG. 5A is a simplified top view of an embodiment of the polishing system illustrating of an arrangement of stationary magnets.

FIG. 5A is a simplified top view of an embodiment of the polishing system 100 illustrating of an arrangement of stationary magnets 184. In one or more embodiments, the stationary magnets 184 may be permanent magnets, electromagnets, or combinations thereof. In this example, a single carrier head 120 is shown disposed over the polishing pad 114, although in practice, the polishing system 100 may include a total of two or more such carrier heads, such as four carrier heads. It will be appreciated that when head sweep is not used, the carrier head 120 and the housing 180 (shown in phantom) may remain stationary. Alternatively, when head sweep is used, the carrier head 120 and the housing 180 may sweep relative to the platen 112. In some embodiments, the housing 180 is fixed relative to the carrier head 120. In some embodiments, the housing 180 may move relative to the platen 112 such that the stationary magnets 184 follow the carrier head 120 and maintain alignment with the circular arc of the movable magnets 210 throughout rotation of the carrier head 120 during sweeping. In some embodiments, the carrier head 120 and the housing 180 may follow a N—S track 194 (shown in phantom) configured to sweep in the N—S direction. In some other embodiments, the carrier head 120 and the housing 180 may follow an E-W track 196 (shown in phantom) having a curved shape configured to sweep in the E-W direction along a circular arc.

In this example, the polishing system 100 has 12 evenly distributed retaining assemblies 200 installed therewith, although any suitable number and distribution of retaining assemblies may be used as described herein. The retaining assemblies 200 are disposed in positions 1-12 as shown. In one or more embodiments, the housing 180 may have magnets disposed only along the leading edge 190 (e.g., positions 1-6) while the trailing edge 192 (e.g., positions 7-12) is free of stationary magnets 184. In this example, the housing 180 includes 6 magnets in positions 1-6 along the leading edge 190, although any suitable number and distribution of stationary magnets 184 may be used as described herein.

Figure 5B:
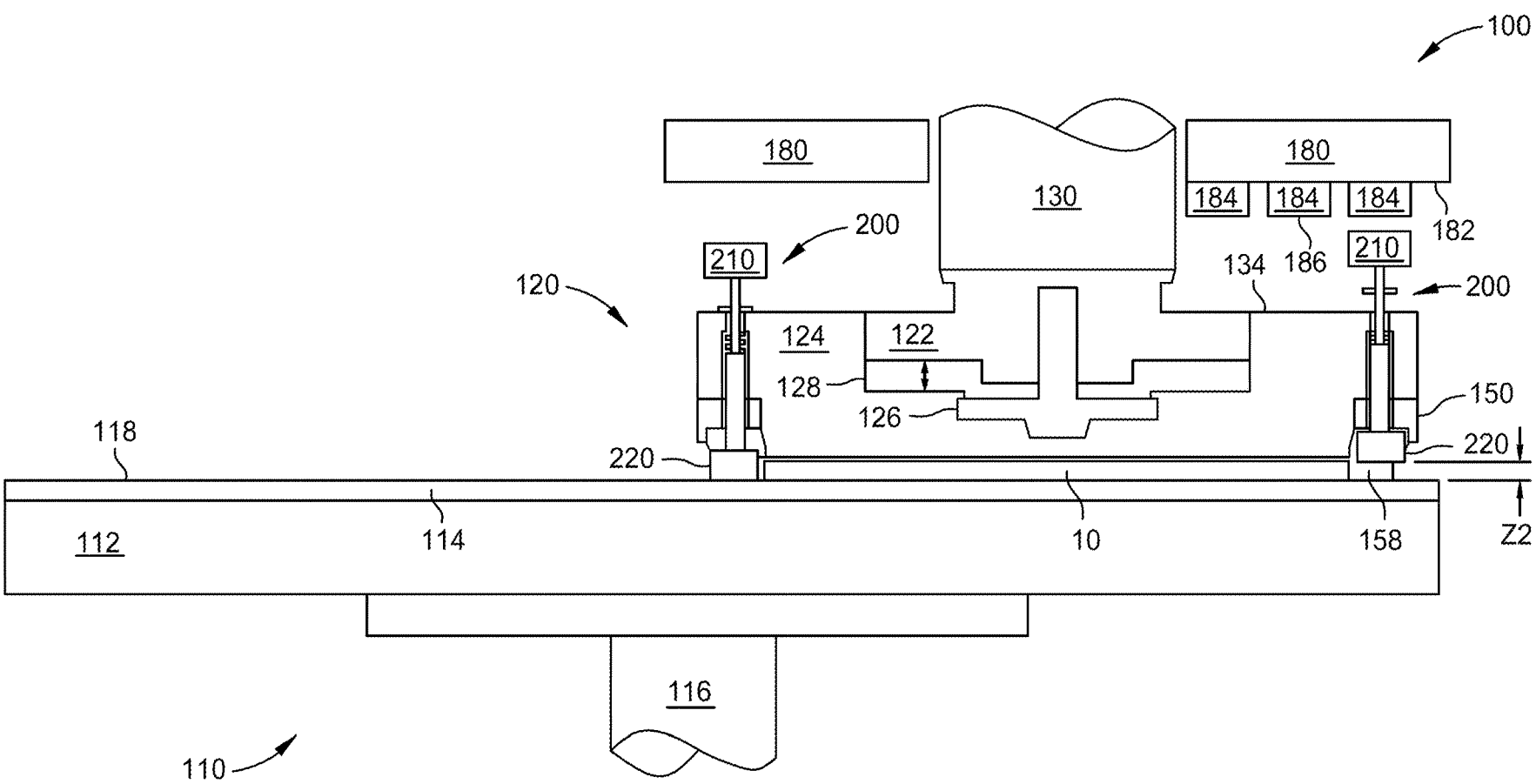
FIG. 5B is a schematic side sectional view of the polishing system of FIG. 5A.

FIG. 5B is a schematic side sectional view of the polishing system 100 of FIG. 5A. Referring to FIG. 5B, each of the retaining assemblies 200 may be biased to the lower position by the spring 216. During rotation, as each retainer 200 and corresponding movable magnet 210 passes under and/or through at least part of a magnetic field of one or more of the stationary magnets 184, a magnetic force will attract the movable magnet 210 lifting the retainer 200 to the upper position as shown on the right side of FIG. 5B. For example, the retainer 200 in position 12 is in the lower position. When the carrier head 120 rotates by 30 degrees CCW, the retainer 200 will move to position 1 where the magnetic force between the stationary magnet 184 in position 1 and the movable magnet 210 will overcome the downward bias force of the spring 216 causing the retainer 200 to move to the upper position. As the retainer 200 moves another 30 degrees CCW to position 2, the magnetic force between the next stationary magnet 184 in position 2 and the movable magnet 210 will maintain the retainer 200 in the upper position. In some embodiments, the retainer 200 may have a response time of about 100 ms or less, such as about 10 ms or less, where the response time is a time for the retainer 200 to move between positions when a magnetic force is applied. The response time is measured, for example, starting when the retainer 200 reaches position 1 and ending when the retainer 200 reaches the upper position. In some embodiments, the response time is faster than a comparable pneumatic system for moving the retainer 200.

In some alternative embodiments, to be described later, the retainer 200 may be biased to the upper position, and the magnetic force may repel the movable magnet 210, pushing the retainer 200 down instead of attracting the movable magnet 210 to lift the retainer 200 up. In some other embodiments, the retainer 200 may be biased to an intermediate position between the upper and lower positions. The same general principles of operation can apply to each embodiment described herein.

In some embodiments, permanent and/or electromagnetic stationary magnets 184 may have different magnetic field strengths to induce gradual lifting to various intermediate positions between the upper and lower positions.

In some embodiments, the stationary magnets 184 may be closely spaced such that the magnetic force is continuous between positions 1 and 2. In some other embodiments, the stationary magnets 184 in positions 1 and 2 may be spaced such that the magnetic fields are strongest in the vertical direction and weakest in the horizontal direction. In other words, the magnetic force on the movable magnet 210 will decrease as the movable magnet 210 moves away from vertical alignment with one or more of the magnets 184; however, the magnetic fields may overlap in the region between adjacent magnets 184, such that an adequate magnetic field can exist to continuously maintain the retainer 200 during transition from position 1 to position 2.

In some other embodiments, the retainer 200 may be continuously maintained in the upper position between position 1 and position 2 simply because the retainer 200 is moved between positions faster than a time required for the retainer 200 to lower from the upper position once the magnetic attraction force is removed.

In some embodiments, the housing 180 may have stationary magnets 184 in positions 1-5 and 12. This arrangement may account for a time required for lifting the retainer 200 to the upper position (e.g., at position 12) and for lowering the retainer to the lower position (e.g., at position 5). In other words, when the retainer 200 is lifted by the stationary magnet 184 in position 12, the retainer 200 may not fully reach the upper position until closer to position 1.

In some other embodiments, the housing 180 may include 5 stationary magnets 184 or less, such as 5 or less, such as 4 or less, such as 3 or less, such as 2 or less, such as 1. In one or more embodiments, the housing 180 may include 4 stationary magnets 184 in positions 2-5, alternatively in positions 1-4. In some other embodiments, the housing 180 may include 3 stationary magnets 184 in positions 2-4. In some other embodiments, the housing 180 may include 2 stationary magnets 184 in positions 3 and 4. In some other embodiments, the housing 180 may include from 6 to about 12 stationary magnets 184, such as 9 stationary magnets.

In one or more embodiments, when the polishing system 100 includes 18 fixed teeth 158 and 18 retaining assemblies 200 as shown in FIG. 4C, the housing 180 may include 9 stationary magnets along the leading edge 190 (e.g., positions 1-9) while the trailing edge 192 (e.g., positions 10-18) is free of stationary magnets 184. In one or more related embodiments, the housing 180 may include 7 stationary magnets 184 in positions 2-8, such as 5 stationary magnets 184 in positions 3-7, such as 3 stationary magnets 184 in positions 4-6. In some other embodiments, the housing 180 may include 9 stationary magnets 184 in positions 1-8 and 18, such as 8 stationary magnets 184 in positions 1-8, such as 6 stationary magnets 184 in positions 2-7, such as 4 stationary magnets 184 in positions 3-6 such as 2 stationary magnets 184 in positions 4 and 5.

It will be appreciated that many other numbers and positions of stationary magnets 184 and retaining assemblies 200 are within the scope of this disclosure, and the present disclosure is not intended to be limiting beyond what is specifically recited in the claims that follow.

In some embodiments, the polishing system 100 of FIGS. 5A-5B may be configured for chemical CMP processes. Chemical CMP processes can be processes where polishing rate and uniformity is dominated primarily by slurry intake and retention, slurry temperature, and/or slurry flow effects as opposed to mechanical processes which are dominated by downforce and/or the effect of abrasives (e.g., silica ($SiO_2$) or ceria ($CeO_2$)). In some embodiments, the movable teeth 220 do not contact the substrate 10, instead acting as a liquid barrier only to control intake and retention of the polishing slurry.

Figure 6A:
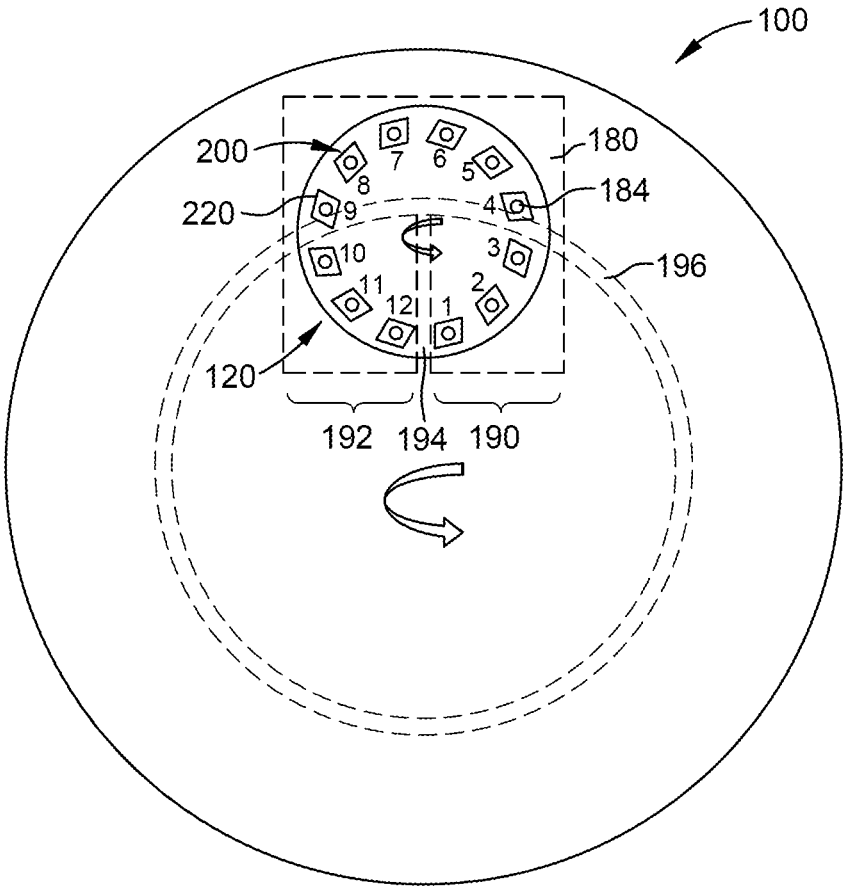
FIG. 6A is a simplified top view of another embodiment of the polishing system illustrating an alternative arrangement of stationary magnets.

FIG. 6A is a simplified top view of another embodiment of the polishing system 100 illustrating an alternative arrangement of stationary magnets 184. In one or more embodiments, the stationary magnets 184 may be permanent magnets, electromagnets, or combinations thereof.

In this example, the polishing system 100 has 12 evenly distributed retaining assemblies 200 installed therewith, although any suitable number and distribution of retaining assemblies may be used as described herein. The retaining assemblies 200 are disposed in positions 1-12 as shown. In one or more embodiments, the housing 180 may have magnets disposed along the leading edge 190 (e.g., positions 1-6) and along the trailing edge 192 (e.g., positions 7-12). In this example, the housing 180 includes 12 magnets in positions 1-12 along both the leading and the trailing edges 190, 192, although any suitable number and distribution of stationary magnets 184 may be used as described herein.

Figure 6B:
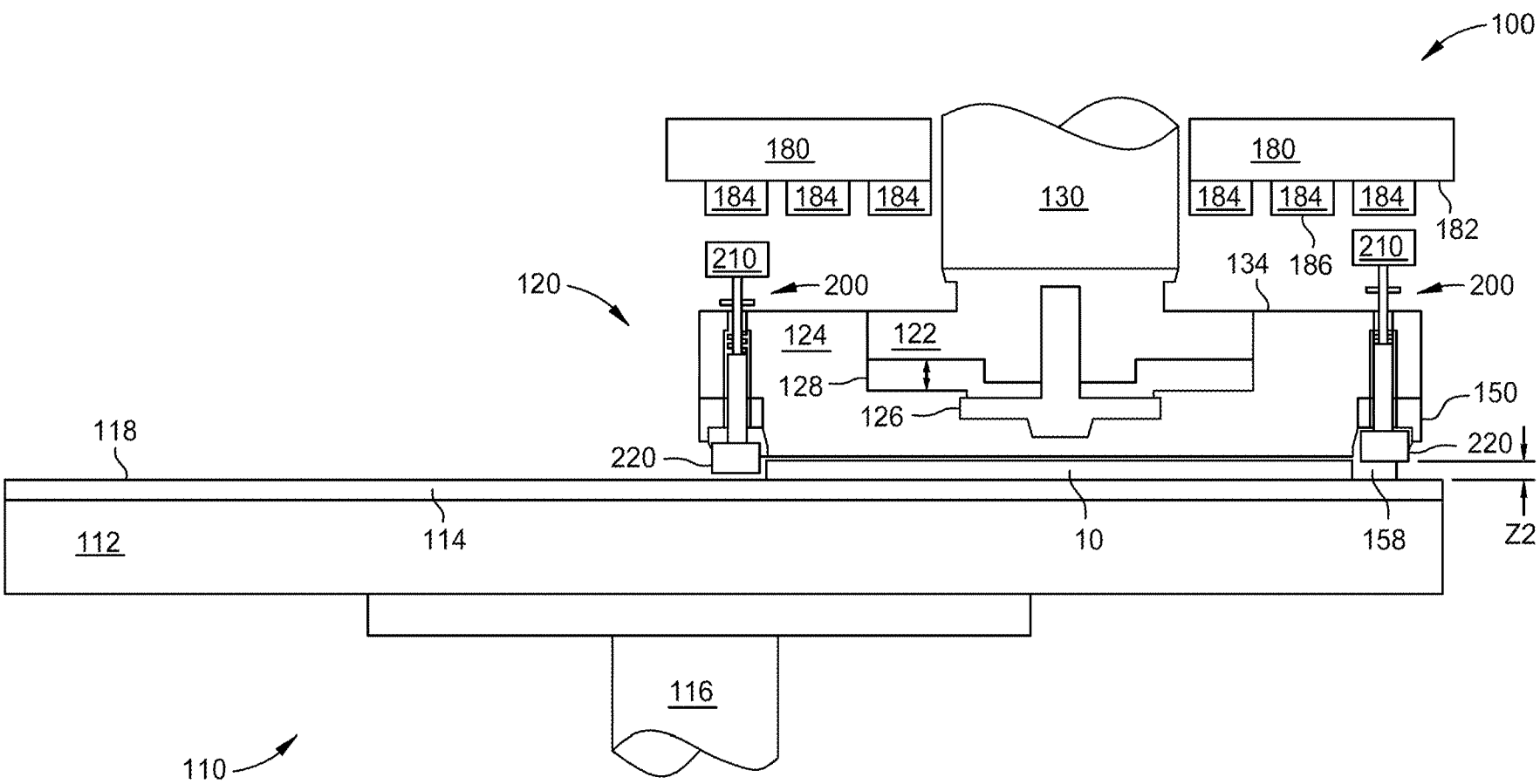
FIG. 6B is a schematic side sectional view of the polishing system of FIG. 6A.

FIG. 6B is a schematic side sectional view of the polishing system 100 of FIG. 6A. Referring to FIG. 6B, each of the retaining assemblies 200 may be biased to the lower position by the spring 216. In this example, the stationary magnets 184 are electromagnets. In some embodiments, electromagnets of the present disclosure can comprise a ferromagnetic core and a wire coil around the core. A controllable magnetic field is created by a direct current through the wire. A strength of the magnetic field is proportional to the current, and an orientation of the magnetic field is controlled by the direction of the current. Using these principles, in one or more embodiments, the stationary magnets 184 can each have an independently controlled magnetic field having controllable strength and controllable orientation.

During rotation, as each retainer 200 and corresponding movable magnet 210 passes under and/or through at least part of a magnetic field of one or more of the stationary magnets 184, a controllable magnetic field can be applied to lift the retainer 200. In some embodiments, the magnetic field can be controlled to lift the retainer 200 to the upper position as shown on the right side of FIG. 6B. In some other embodiments, the magnetic field can be controlled to lift the retainer 200 to an intermediate position as shown on the left side of FIG. 6B, where the intermediate position is any position between the lower position and the upper position. In one or more embodiments, the spring 216 may be omitted and the magnetic field of one or more of the stationary magnets 184 can be set to maintain the retainer 200 in the lower position.

In one or more embodiments, the stationary magnets 184 on the leading edge 190 (e.g., positions 1-6) may be controlled to have a magnetic field strength and orientation to maintain the retainer 200 in the upper position, and the stationary magnets 184 on the trailing edge 192 may be controlled to have a magnetic field strength and orientation to maintain the retainer 200 in the intermediate position. In some other embodiments, the stationary magnets 184 on the trailing edge 192 may be controlled to have a magnetic field strength and orientation to maintain the retainer 200 in the lower position.

In some embodiments, an alternating pattern may be applied where every other stationary magnet 184 (e.g., positions 1, 3, 5, 7, 9, and 11) may be controlled to maintain the retainer 200 in the upper position, and the remaining stationary magnets 184 (e.g., positions 2, 4, 6, 8, 10, and 12) may be controlled to maintain the retainer 200 in the lower position. Thus, the alternating pattern can induce a snake-like motion of the retaining assemblies 200 during rotation of the carrier head 120. In some other embodiments, the stationary magnets 184 may be controlled to move the retaining assemblies 200 in a sinusoidal pattern.

In some other embodiments, the stationary magnets 184 may be controlled to continuously vary the gap Z2 around the circumference of the carrier head 120. For example, the gap Z2 may have a maximum value at positions 3 and 4, and the gap Z2 may decrease at each subsequent position moving CCW from position 4 to position 9 and moving CW from position 3 to position 10, such that the gap Z2 has a minimum value at positions 9 and 10. Gradual lifting of the retaining assemblies 200 around the circumference of the carrier head 120 may also be applied to other embodiments described herein.

It will be appreciated that many other control strategies of the stationary magnets 184 are within the scope of this disclosure, and the present disclosure is not intended to be limiting beyond what is specifically recited in the claims that follow.

In some embodiments, the polishing system 100 of FIGS. 6A-6B may be configured for chemical CMP processes. In some embodiments, the movable teeth 220 do not contact the substrate 10, instead acting as a liquid barrier only to control intake and retention of the polishing slurry.

Figure 7A:
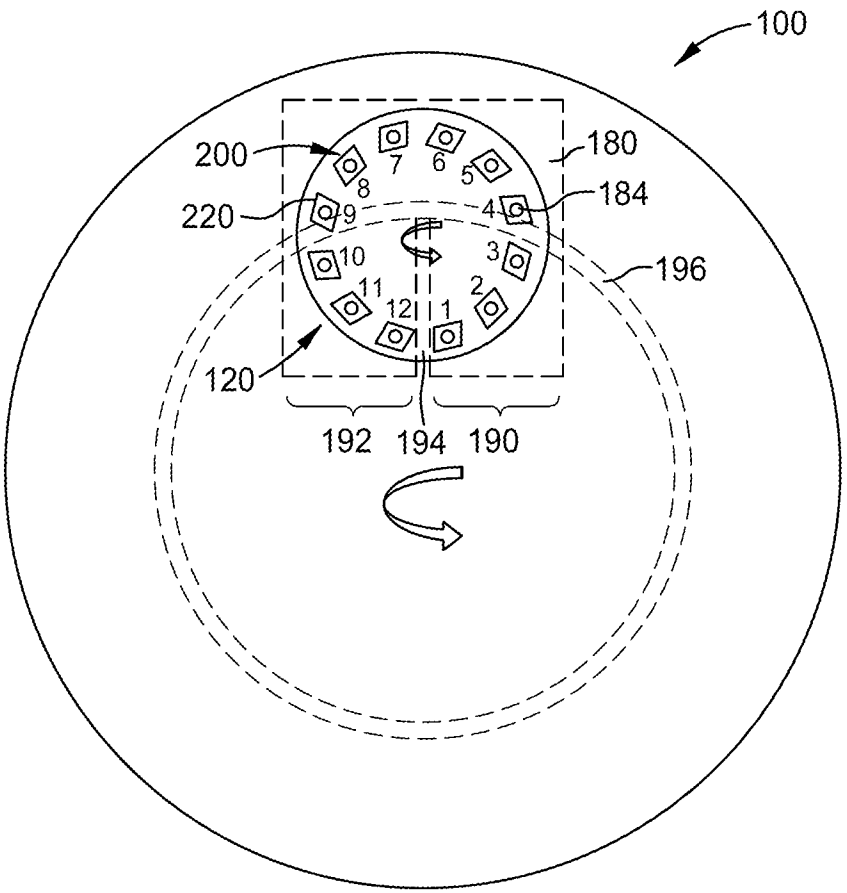
FIG. 7A is a simplified top view of yet another embodiment of the polishing system.

FIG. 7A is a simplified top view of yet another embodiment of the polishing system 100. In one or more embodiments, a downforce of each movable tooth 220 may be independently controlled, such that a varying force can be applied to the polishing pad 114 around the circumference of the substrate 10. In one or more embodiments, one or more of the stationary magnets 184 on the leading edge 190 (e.g., positions 1-6) may be controlled to apply a minimum downforce. In some embodiments, the minimum downforce may be a negative upward force. Concurrently, one or more of the stationary magnets 184 on the trailing edge 192 (e.g., positions 7-12) may be controlled to apply a maximum downforce.

In some embodiments, an alternating pattern may be applied where every other stationary magnet 184 (e.g., positions 1, 3, 5, 7, 9, and 11) may be controlled to apply a minimum downforce, and the remaining stationary magnets 184 (e.g., positions 2, 4, 6, 8, 10, and 12) may be controlled to apply a maximum downforce. Thus, the alternating pattern can induce a low frequency oscillating downforce by the retaining assemblies 200 on the polishing pad 114.

Figure 7B:
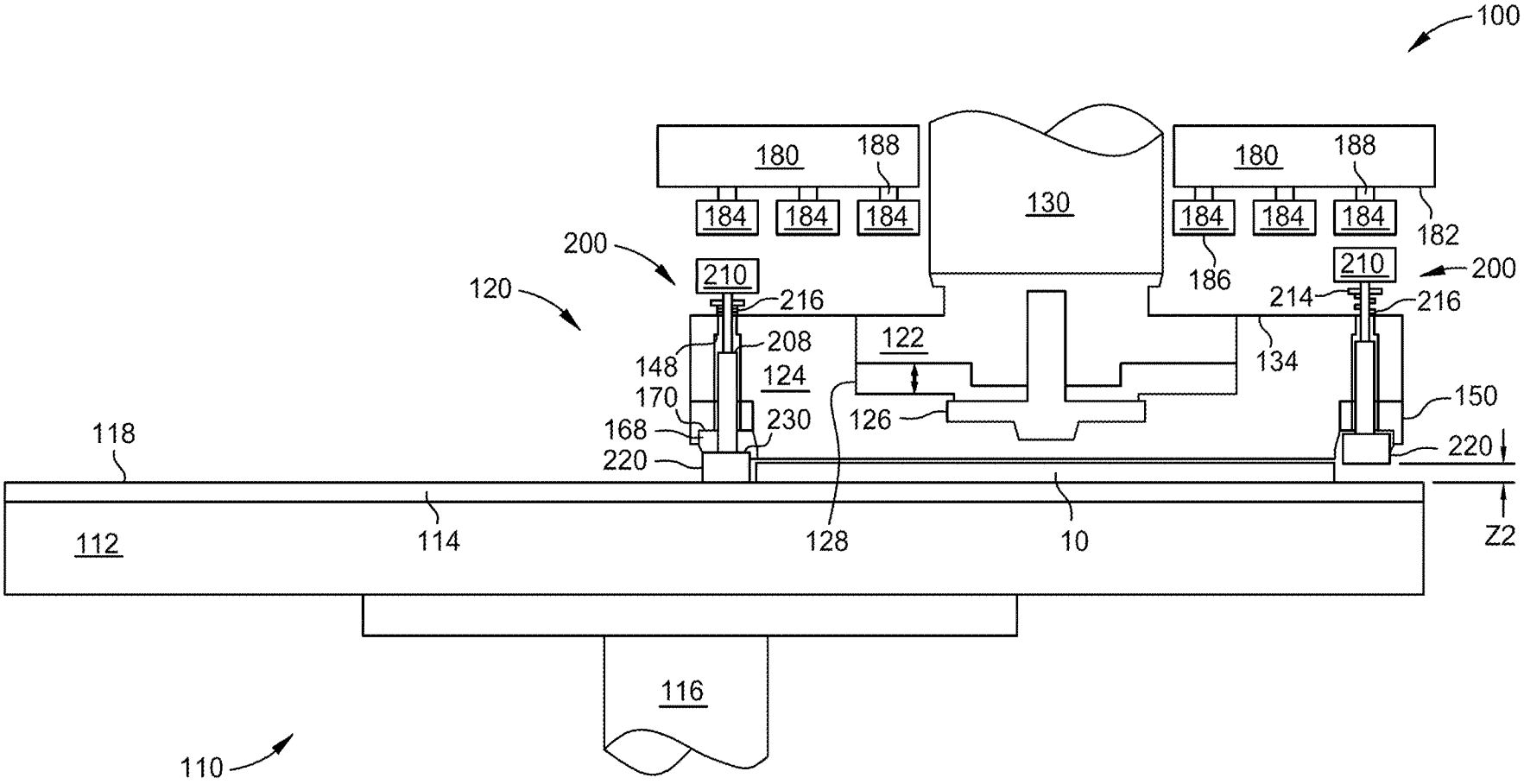
FIG. 7B is a schematic side sectional view of the polishing system of FIG. 7A.

FIG. 7B is a schematic side sectional view of the polishing system 100 of FIG. 7A. Referring to FIG. 7B, each stationary magnet 184 may be indirectly attached to the bottom surface 182 of the housing 180 by a strain gauge 188. Strain gauges of the present disclosure may operate under tension and/or compression to measure a force on each of the stationary magnets 184. In one or more embodiments, the stationary magnets 184 may be permanent magnets, electromagnets, or combinations thereof. In one or more embodiments, feedback from the strain gauges 188 can be used to control downforce.

As illustrated in FIG. 7B, the spring 216 may be disposed between the lower stop shoulder 214 and the top surface 134 of the carrier head 120 to bias the retainer 200 toward the upper position. In such embodiments, the shoulder 148 of the carrier head 120 can be an upper stop shoulder, and contact between the shoulder 148 and the shoulder 208 of the retainer 200 can limit upward movement of the retainer 200. In some other embodiments, the top surface 230 of each movable tooth 220 can be an upper stop shoulder, and contact between the top surface 230 and the shoulder 170 of the groove 168 in the retaining ring 150 can limit upward movement of the retainer 200.

In some other embodiments, the spring 216 may be disposed to bias the retainer 200 toward the lower position. In some other embodiments, the spring 216 may be omitted.

In one or more embodiments, a magnetic field orientation of the stationary magnets 184 may be controlled to apply a downforce to the retainer 200. In some embodiments, from a top-down perspective, the magnetic field of the stationary magnets 184 may be oriented N-S when the movable magnets 210 are oriented S-N. In some other embodiments, also from a top-down perspective, the magnetic field of the stationary magnets 184 may be oriented S-N when the movable magnets 210 are oriented N-S. In either case, the magnetic field of the stationary magnets 184 will repel the movable magnets 210.

In one or more embodiments, the movable teeth 220 may contact the substrate 10, acting as retaining teeth to retain the substrate 10. In one or more embodiments, the movable teeth 220 may apply a downforce to the polishing pad 114. In some other embodiments, the plurality of fixed teeth 158 may retain the substrate 10 and/or apply a downforce to the polishing pad 114. In other words, the vertical positions of the plurality of fixed teeth 158 and the movable teeth 220 may be reversed relative to some other embodiments, such that grooves are formed between lateral surfaces of adjacent movable teeth 220 to convey the polishing slurry. In one or more embodiments, the grooves may have width a about equal to a conventional retaining ring groove width. In some embodiments, the width may be from about 3 mm to about 25 mm, such as from about 3 mm to about 13 mm, such as about 6 mm.

In one or more embodiments, each of the fixed teeth 158 may be vertically spaced from the polishing pad 114 by a gap Z2 about equal to a conventional retaining ring groove depth. In some embodiments, the gap Z2 may be from about 5 mm to about 12 mm, such as from about 7 mm to about 10 mm, such as about 7 mm. In some embodiments, each of the fixed teeth 158 may be spaced from the polishing pad 114 by a distance about equal to a thickness of the substrate 10 or greater.

In some embodiments, as a downforce is applied by each movable tooth 220 on the polishing pad 114, an equal and opposite reaction force may be applied by the movable magnet 210 on the stationary magnets 184. The upward reaction force can be measured by one or more of the strain gauges 188 to provide real-time feedback of the magnitude of the downforce applied by each respective movable tooth 220 on the polishing pad 114. Thus, by using the strain gauges 188, the applied downforce can be continuously monitored and adjusted.

In some embodiments, the polishing system 100 of FIGS. 7A-7B may be configured for mechanical CMP processes. In some embodiments, the movable teeth 220 may contact the substrate 10, acting as retaining teeth to retain the substrate 10. In some other embodiments, the movable teeth 220 do not have contact with the substrate 10, instead acting as a liquid barrier only to control intake and retention of the polishing slurry.

Embodiments of the present disclosure using magnetic control offer contactless operation, among other advantages. In particular, the interactions between the stationary magnets 184 and the movable magnets 210 are contactless. In other words, vertical forces are applied to the retaining assemblies 200 without allowing the mating parts, which can be blocked or coated with debris during operation, to come into physical contact with each other.

In one or more embodiments, the retaining assemblies 200 may be controlled using a pneumatic system. In some embodiments, in place of the stationary magnets 184 and the movable magnets 210, a plurality of pneumatic supply lines may be used to supply air pressure to move each of the retaining assemblies 200. In one or more embodiments, a slip-ring may be used to couple the pneumatic supply lines between the housing 180 and the retaining assemblies 200. In one or more embodiments, a single pneumatic supply line may supply air pressure to move each retainer 200 in a first direction and a spring 216 may be used to bias each retainer 200 in the opposite direction. In some other embodiments, a first pneumatic supply line may supply air pressure to move each retainer 200 in a first direction and a second pneumatic supply line may supply air pressure to move each retainer 200 in the opposite direction. In some embodiments, the pneumatic system may have a response time of about 250 ms or greater.

In one or more embodiments, the polishing system 100 may include a closed-loop control system, which may be generally referred to as a feedback control system. In one or more embodiments, the closed-loop control system may operate in real-time. In some embodiments, the closed-loop control system may independently monitor and control a downforce applied by each movable tooth 220. In some embodiments, the closed-loop control system may independently monitor and control a gap Z2 between each movable tooth 220 and the polishing pad 114. In one or more embodiments, the closed-loop control system may receive inputs from eddy current sensors and/or optical sensors to measure wafer thickness and/or wafer non-uniformity in situ. In some embodiments, sensors on or within the platen 112 may sense the wafer thickness. In some embodiments, the in situ measurements can be used to control membrane pressure and/or downforce. For example, membrane pressure can be adjusted across various zones of the membrane 138 in order to more evenly polish the wafer.

In some embodiments, the closed-loop control system can perform active control of downforce of the retaining assemblies 200. In some embodiments, the closed-loop control system can receive signals from each of the strain gauges 188 providing real-time feedback of the magnitude of the downforce applied by each respective movable tooth 220 on the polishing pad 114. In addition, the closed-loop control system can receive signals from the one or more eddy current sensors and/or optical sensors, which are positioned to detect the thickness of a material layer formed on the wafer and are used to detect the thickness profile of the wafer 10 and/or edge profile of the wafer 10. In some embodiments, the foregoing signals can be utilized to continuously monitor and adjust the applied downforce of each movable tooth 220. In some embodiments, optimal downforce can depend on parameters including pressure of the membrane 138, rotation rate of the polishing pad 114, rebound rate of the polishing pad 114, rotation rate of the wafer 10, and slurry composition. In some embodiments, the optimal downforce can be determined experimentally.

In one example of CMP process, when the closed-loop control system determines a non-uniformity in thickness at the edge of the wafer 10 resulting from excess downforce, the closed-loop control system may actively reduce the downforce of each movable tooth 220. Alternatively, when the closed-loop control system determines a non-uniformity in thickness at the edge of the wafer 10 resulting from inadequate downforce, the feedback control system may actively increase the downforce of each movable tooth 220. In some embodiments, the non-uniformity may be corrected by independently adjusting the downforce of one or more of the movable teeth 220, and in some cases adjust the downforce of one or more of the movable teeth 220 and the pressure applied by an outer zone of the polishing head. In some embodiments, a magnitude of the downforce applied by each movable tooth 220 may be precisely controlled to reduce non-uniformity in real-time. In some embodiments, the downforce of each movable tooth 220 can be selected in order to limit decompression of the polishing pad 114 in a gap between the movable tooth 220 and the edge of wafer 10.

In some other embodiments, the closed-loop control system can perform active control of the gap Z2 between the bottom surface 222 of each movable tooth 220 and the polishing pad 114. In some embodiments, the closed-loop control system can receive signals from sensors coupled to one or more of the retaining assemblies 200, movable teeth 220, carrier head 120 or retaining ring 150 providing real-time feedback of the gap Z2 between each respective movable tooth 220 and the polishing pad 114. In addition, the closed-loop control system can receive signals from the one or more eddy current sensors and/or optical sensors indicating thickness profile of the wafer 10 and/or edge profile of the wafer 10. In some embodiments, the depth D3 of each groove 168 may be reduced as the bottom surfaces 160 of the fixed teeth 158 wear down during use. In some embodiments, the depth D3 may be proportional to the usage of the retaining ring 150. Thus, the usage history of the retaining ring 150 may be another input to the closed-loop control system. In some embodiments, the foregoing signals can be utilized to continuously monitor and adjust the gap Z2 of each movable tooth 220 in order to control slurry intake and/or retention.

For example, when the closed-loop control system determines a non-uniformity in thickness that may be corrected by adjusting slurry intake and/or retention, the closed-loop control system may actively adjust the gap Z2 of each movable tooth 220 in order to correct the non-uniformity. Alternatively, when the closed-loop control system determines a change in the depth D3 of one or more of the grooves 168, the closed-loop control system may actively adjust the gap Z2 of each movable tooth 220 to compensate for the change. In some embodiments, the gap Z2 of each movable tooth 220 can be selected in order to conserve polishing slurry.

While the foregoing is directed to embodiments of the present disclosure, other and further embodiments of the disclosure may be devised without departing from the basic scope thereof, and the scope thereof is determined by the claims that follow.

What is claimed is:

1. A retaining ring assembly configured to be attached to a carrier head, the retaining ring assembly comprising:

a retaining ring including a lower surface, an inner surface, an outer surface and a plurality of grooves, wherein the lower surface is configured to contact a polishing pad during a polishing process, and each of the plurality of grooves are formed in the lower surface and extend from the inner surface to the outer surface; and a plurality of retainers, each retainer including a movable tooth at least partially disposed in a respective groove of the retaining ring and moveable relative to the lower surface.

2. The retaining ring assembly of claim 1, wherein each retainer further comprises a shaft and a movable magnet, wherein the movable tooth is coupled to a bottom end of the shaft, and wherein the movable magnet is coupled to a top end of the shaft.

3. The retaining ring assembly of claim 2, wherein the retaining ring further comprises a plurality of thru-holes aligned with the plurality of grooves, and wherein each shaft is disposed in a respective thru-hole.

4. The retaining ring assembly of claim 1, wherein the plurality of retainers are disposed around a central axis of the retaining ring.

5. A system for polishing a substrate, comprising:

a housing including a plurality of stationary magnets;

a carrier head disposed adjacent to the housing; and a retaining ring assembly attached to the carrier head, the retaining ring assembly comprising:

a retaining ring including a lower surface, an inner surface, an outer surface and a plurality of grooves, wherein the lower surface is configured to contact a polishing pad during a polishing process, and each of the plurality of grooves are formed in the lower surface and extend from the inner surface to the outer surface;

a movable magnet disposed within a magnetic field of a first stationary magnet of the plurality of stationary magnets; and a movable tooth coupled to the movable magnet and disposed within a groove of the plurality of grooves.

6. The system of claim 5, wherein the plurality of stationary magnets are attached to a bottom surface of the housing, and wherein the plurality of stationary magnets are disposed around a central axis of the carrier head.

7. The system of claim 6, wherein the plurality of stationary magnets are disposed 180 degrees or less around the central axis of the carrier head.

8. The system of claim 6, wherein the carrier head is positioned below the housing, wherein the carrier head has a top surface facing the bottom surface of the housing, and wherein the movable magnet is at least partially disposed above the top surface of the carrier head.

9. The system of claim 6, wherein the carrier head is configured to rotate about the central axis, and wherein the movable magnet is configured to pass through a respective magnetic field generated by each of the plurality of stationary magnets as the carrier head is rotated about the central axis.

10. The system of claim 5, wherein the movable tooth is movable in a first direction within a groove of the plurality of grooves, and the first direction is substantially perpendicular to the lower surface.

11. The system of claim 10, further comprising a plurality of strain gauges coupled to the plurality of stationary magnets, the plurality of strain gauges configured to measure a downforce of the movable tooth.

12. The system of claim 5, wherein the movable magnet comprises a ferromagnetic material.

13. The system of claim 5, wherein the plurality of stationary magnets are electromagnets.

14. A method for polishing a substrate, comprising:

disposing the substrate in a polishing system, the polishing system comprising:

a housing including a plurality of stationary magnets;

a carrier head disposed adjacent to the housing; and a retaining ring assembly attached to the carrier head, the retaining ring assembly comprising:

a retaining ring including a lower surface, an inner surface, an outer surface and a plurality of grooves, wherein the lower surface is configured to contact a polishing pad during a polishing process, and each of the plurality of grooves are formed in the lower surface and extend from the inner surface to the outer surface;

a movable magnet; and a movable tooth coupled to the movable magnet and disposed within a groove of the plurality of grooves;

rotating the carrier head to a first angular position relative to the housing, wherein the moveable tooth has a first vertical position when the carrier head is in the first angular position; and rotating the carrier head to a second angular position relative to the housing, wherein the second angular position is different from the first angular position, and wherein the moveable tooth moves to a second vertical position different from the first vertical position.

15. The method of claim 14, wherein rotating the carrier head to the second angular position aligns the movable magnet with a first stationary magnet of the plurality of stationary magnets causing the moveable tooth to move relative to the first stationary magnet.

16. The method of claim 15, wherein the first stationary magnet is an electromagnet, and wherein a movement distance of the moveable tooth is controlled by a current applied to the first stationary magnet.

* * * * *